United States Patent [19]

Becker et al.

[11] 4,371,041

[45] Feb. 1, 1983

[54] MULTI-PURPOSE MOBILE DRILL RIG

[75] Inventors: Floyd W. Becker; Richard R. Regimbal, both of Calgary, Canada

[73] Assignee: Drill Systems, Inc., Calgary, Canada

[21] Appl. No.: 942,550

[22] Filed: Sep. 15, 1978

[51] Int. Cl.[3] ..... E21B 7/02; E21C 11/02

[52] U.S. Cl. ..... 173/28; 173/147; 175/85

[58] Field of Search ..... 173/23, 28, 147; 175/85

[56] References Cited

U.S. PATENT DOCUMENTS

| | | | |
|---|---|---|---|
| 2,904,310 | 9/1959 | Leonard | 173/28 X |
| 2,963,100 | 12/1960 | Smith | 173/131 X |
| 3,280,925 | 10/1966 | Becker et al. | 173/28 X |
| 3,438,450 | 4/1969 | Failing | 173/28 X |
| 3,495,667 | 2/1970 | Cales . | |
| 3,576,218 | 4/1971 | Lisenby | 173/28 |
| 3,613,906 | 10/1971 | Deyo | 175/85 X |
| 3,708,024 | 1/1973 | Back | 173/23 X |
| 3,766,995 | 10/1973 | Young et al. | |
| 3,896,887 | 7/1975 | Council | 173/28 X |
| 3,921,739 | 11/1975 | Rich et al. | |
| 4,102,094 | 7/1978 | MacKinnon | |

FOREIGN PATENT DOCUMENTS

| | | | |
|---|---|---|---|
| 460673 | 10/1973 | Australia . | |
| 2225521 | 12/1972 | Fed. Rep. of Germany | 175/85 |
| 350832 | 4/1905 | France . | |

*Primary Examiner*—Robert Mackey

*Attorney, Agent, or Firm*—Klaas & Law

[57] ABSTRACT

A drill rig for drilling a hole in the ground including a mast, having a longitudinal slide means at one face thereof, adapted to be set upright with the slide means facing, and being at a selected spacing from and parallel to the axis of a drill hole to be drilled with the rig; a slide frame mounted upon the mast slide means and lifter-pulldown means in the mast to move the slide frame along the longitudinal slide means; a lateral shifting means on the slide frame shiftable towards and away from the slide frame in the direction of the drill hole; a drill carrier attached to the shifting means to be shifted to a first position against the slide frame and to a second position outwardly therefrom; and a drill mechanism means including a drill pipe means mounted upon the drill carrier to effect drilling by a drill pipe means, with the drill pipe means being aligned with the drill hole axis when the drill carrier is at one of said positions.

30 Claims, 29 Drawing Figures

10
10
30
60
66
67
68
70
71
72
73
74
75
76
77
78
79
34
36

19
19
45
45
45
45
160
161
168
168
160
165
167
165
160
169
170
163
163
167
40
162
165
164
165
167
168
167
166
164
42
160
161
31
40
91
165
163

54
188
189
175
50
175
175a
178R
175a
181
191
179
178L
182
190
183
180
181
191
185
184
55
176
184a
186
186
185
187
177
52

MULTI-PURPOSE MOBILE DRILL RIG

BACKGROUND OF THE INVENTION

The present invention relates to truck mounted mobile drilling rigs, and more particularly to an improved truck mounted mobile drilling rig which can be used with any of several drilling methods.

The common mobile drilling rigs now in use mount a mast at the rear end of a large truck which may be retracted to lie horizontally or nearly horizontally over the truck, but which can be swung to an upright, vertical position for drilling. In the ordinary drilling operation, the truck will back up to align the drilling mast at the rear over a proposed or existing hole. The truck is then stabilized and leveled by suitable outriggers at each end of the truck.

Ordinarily the drill rig truck will carry the machinery necessary to provide suitable power to compress air and to pump liquid as needed, depending upon the drilling equipment associated with the mast. If necessary, auxiliary vehicles can be used to carry extra compressors and the like. The drilling equipment carried on the truck can be of various types for different drilling methods. For example, impact type drills will include pile drivers, air hammers and churning bits. Rotary type drills will include roller and fishtail bits attached to single and double wall drill stems, diamond bits and augers. One can find different, specialized types of drilling rigs for these special drilling methods. Pile drivers are ordinarily used in overburden and unconsolidated sediments. Rotary drills are usually used for drilling wells. Diamond drills on different types of vehicles are used for obtaining hard rock core samples. Wagon drills carry jackhammers to drill in hard rock for setting explosives. Auger drills specialize in drilling holes and/or obtaining core samples in soil and overburden.

The general trend and development has been to adapt each drill rig for a special use and the operator will specialize in a single type of drilling such as water well drilling. However, field operations are not always suitable for a single drilling method and sometimes different drilling methods must be combined and several different types of drilling rigs are needed for the same job. A rotary, or impact type of drill is needed to drive a shaft through overburden and to rock before an exploratory diamond drill can be used to cut to take cores from the bedrock formation. This use of different drill rigs is an expensive proposition. Also, a difficult problem and a tedious chore can arise in setting a drill rig over an existing hole where precise alignment is important.

It follows that there is a real and definite need for an improved drilling system to better cope with problems such as those outlined above and the present invention was conceived and developed with such and other considerations in view. The invention comprises, in essence, a multi-purpose mobile drill rig having a mast carried at the rear end of a truck which is shiftable from a horizontal retracted position over the truck to a vertical operative position for drilling. Also, this mast can drill at selected inclined positions if necessary. The mast carries a multi-purpose drill support which can carry any of several different types of drills including a pile driver, a rotary drill, a diamond drill and a jackhammer also called an air hammer. The drill rig may use air or water or a combination of both and it is capable of quickly shifting from one type of drilling method to another.

It follows that objects of the present invention are to provide a novel and improved multi-purpose drill rig which: is adapted for drilling by any one of several drilling methods; can quickly and easily shift from one drilling method to another without changing the set-up of the rig and without moving off the hole; can quickly and easily shift a drill out of alignment with the hole when other work is necessary such as setting casing or retrieving a drill stem; and which is an economical, rugged and durable unit.

With the foregoing and other objects in view, all of which more fully hereinafter appear, our invention comprises certain constructions, combinations and arrangements of parts and elements as hereinafter described, defined in the appended claims and illustrated in preferred embodiments in the accompanying drawings, in which:

GENERAL DESCRIPTION OF THE INVENTION

It is to be understood that many components herein described are designated by common terms with their function being implied. Such is not intended to be restrictive for various equivalent means can be used in lieu of such components.

Figure 1:
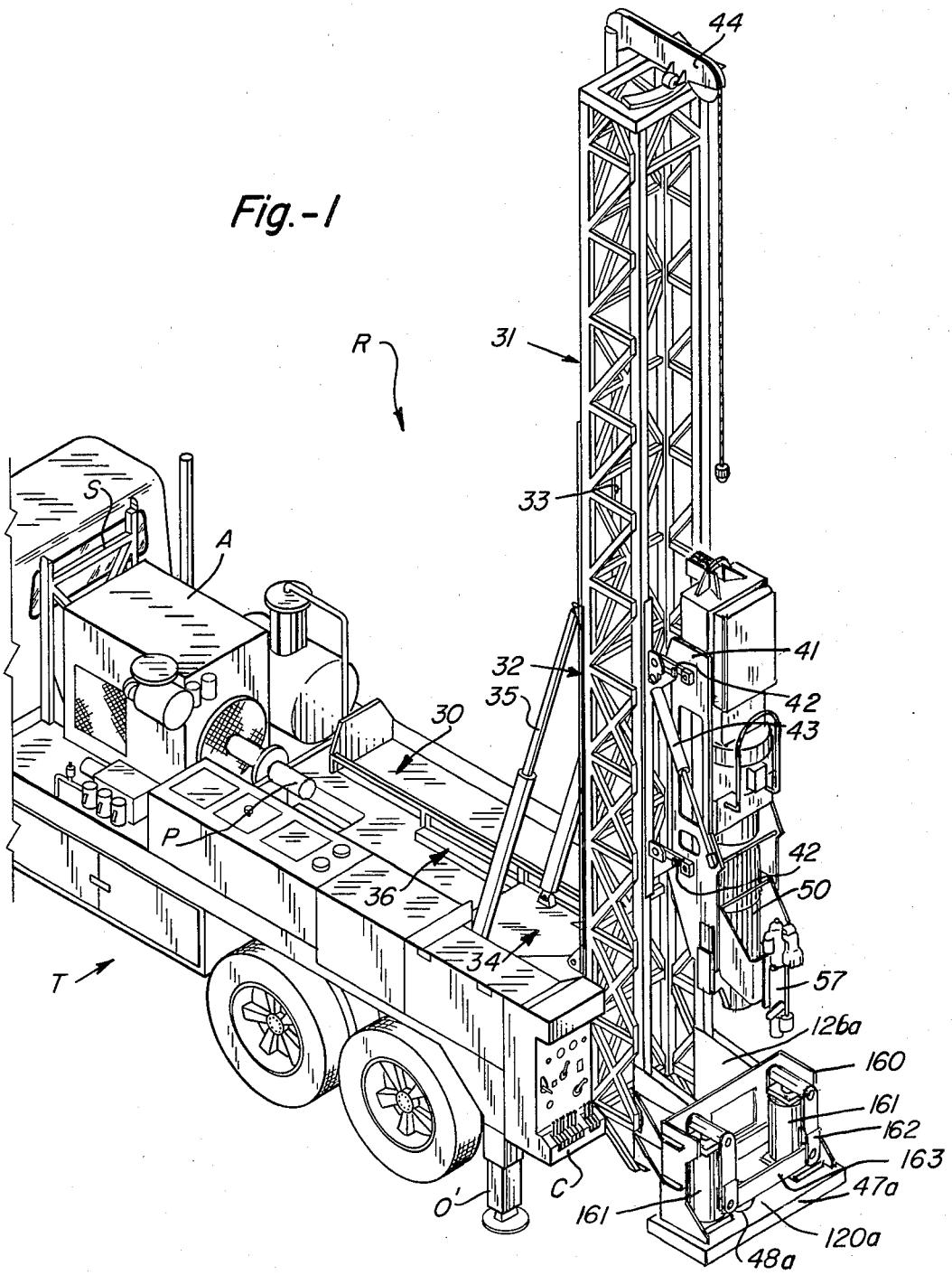
FIG. 1 is a perspective view of a drill rig apparatus of the present invention, mounted upon a truck, with the mast in a vertical drilling position, with the drill carrier at an intermediate position on the mast with a pile driver hammer mounted on the carrier and with certain components not shown including mast slide cylinders, deck slide cylinders, the drill carrier, lifter-downpull cables and conventional piping and feed lines.

Referring to FIG. 1, an improved, mobile multiple purpose drilling rig R is mounted upon the frame of a truck T. The truck has lifting outriggers O at its front. Rear outriggers O′ are attached to the frame of the drilling rig R. The drilling rig unit includes an elongated deck 30 which forms the bed of the truck and the drill rig mast 31 is at the rear end of this deck, that is, with respect to the rear of the truck. All other components forming the rig will, also be referred to as being forwardly and rearwardly, when necessary, with respect to the truck. An air compressor A, a hydraulic pump P and other components for operating the drill rig R are carried at the forward end and at the sides of the deck while the operators control console C is carried at the rear end of the deck alongside the mast 31. The compressor A, the pump P, the engine, not shown, the operating components and the control console C are all conventional and need not be further described. Also, in the following description, it is to be noted that a number of other conventional parts and components, such as pressure lines to hydraulic cylinders are neither shown nor described.

Figure 6:
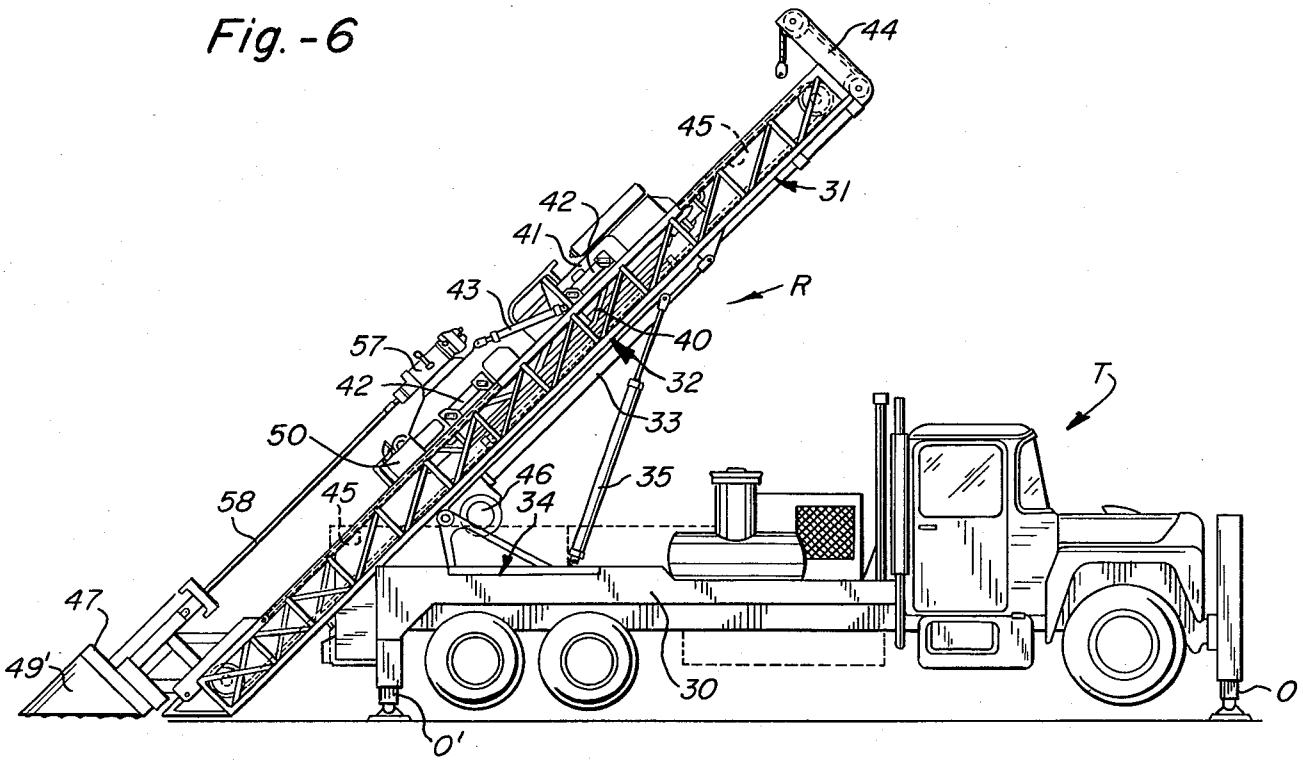
FIG. 6 is a side elevational view of the drill rig of FIG. 2 and carrying a jackhammer as shown at FIG. 5, but with the mast being at an inclined drilling position.

The drilling rig R includes the mast 31 to carry various types of drilling apparatus and this mast 31 is movably mounted for longitudinal slidable movements, vertical slidable movements and tipping movements. The mast may tip forwardly (with respect to the truck) from a vertical operating position to a near horizontal transport position over the truck T with the upper end of the mast resting upon strut supports S at the front end of the deck 30 as indicated in broken lines at FIG. 2. The mast 31 may also be operated at an inclined position as shown at FIG. 6.

To attain this desirable flexibility in positioning and tipping the mast, the mast is slidably affixed to a mast slide 32 at the forward face of the mast 31. Movement of the mast 31 along this mast slide 32 is controlled by hydraulic cylinders 33, best shown at FIGS. 2 and 6. The base of the mast slide 32 is pivotally connected to the rear end of a deck slide 34 to permit the mast slide 32 and its mast 31 to be tipped forwardly from a vertical position and over the deck slide 34. This tipping movement is controlled by hydraulic cylinders 35, connecting with the front of the deck slide and with the top of the mast slide. The deck slide 34, in turn, is mounted upon horizontal, longitudinally-disposed, opposing guideways 36 at the rear section of the deck 30. A cylinder means, not shown, is connected to the underside of the deck slide 34 and to the deck 30 to shift the deck slide forwardly and rearwardly on the deck.

Figure 2:
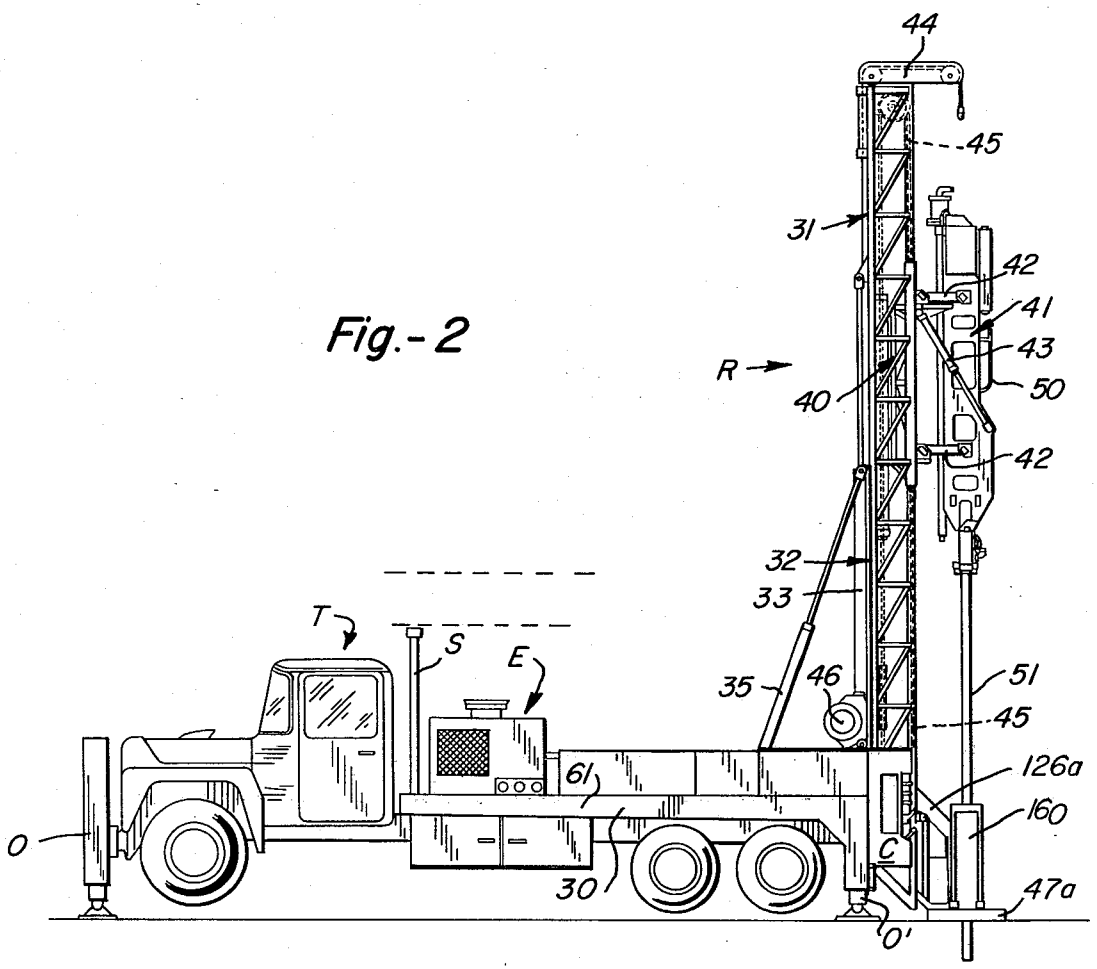
FIG. 2 is a side elevational view of the drill rig of FIG. 1 with the mast vertical with the drill carrier at an intermediate position on the mast and with the pile drive hammer mounted on the carrier for driving a pipe into the earth, the carrier lifter-pulldown cables being shown in broken lines.

The selected drilling mechanisms, hammers and rotary units, are carried at the rear of the mast. A slide frame 40 is slidably mounted between the elongated structural cords, a slide means, at the rear of the mast, and the slide frame supports a carrier 41 wherein a drilling mechanism is mounted. It is to be noted that the rear side of the mast is open, that is without cross struts so that the rearward portion of the slide frame 40 may project into the embrace of the mast. The carrier 41 is shiftably connected to the slide frame 40 by parallelogram linkages 42, a shifting means, to normally extend rearwardly from the mast but to swing inwardly against the slide frame and within the embrace of the slide frame and partially into the mast. This longitudinal swinging movement is effected by diagonally placed cylinders 43 connecting with the slide 40 and carrier 41 and such movement provides a quick shift of the drilling mechanism whenever pipe pulling operations or the like are under way as with the aid of a pipe handling crown block 44 at the top of the mast. The slide frame 40 is connected with lifter-pulldown cables 45 extending from the top to the bottom of the mast 31 to forcibly raise and lower drilling mechanisms mounted on the carrier 41 as shown at FIG. 2. A compound drum hoist 46 is mounted on the mast slide 32 to operate the boom at the top of the mast and the lifter-pulldown cables 45 as shown at FIG. 2.

To prepare the drill rig R for operation, a selected drilling mechanism is fitted upon the carrier 41 and after the drill rig is in place and the mast raised, various supply and scavenging lines and other equipment, not shown, will be installed. A suitable ground shoe 47 or 47*a* having a pipe passageway 48 or 48*a* through it will be connected to the base of the mast 31 and the mast will be lowered to place the shoe 47 or 47*a* onto the ground. The ground shoe 47 will outstand rearwardly from the mast with its center opening 48 in alignment with a drill stem depending from the drilling mechanism thereabove. The ground shoe 47 will include a breakout means within it to grip the drill stem, and to break and unwind drill stem joints as hereinafter described.

The ground shoe 47*a*, for a pile drive drilling mechanism, will include a pipe pulling means as hereinafter described.

One or several drilling mechanisms may be mounted upon the carrier 41 for providing a variety of drilling modes and methods including pile driving, rotary well drilling, diamond drilling and jackhammer drilling. A selected method may be set up for a given drilling operation which will include several or all of the above mentioned drilling mechanisms.

Figure 5:
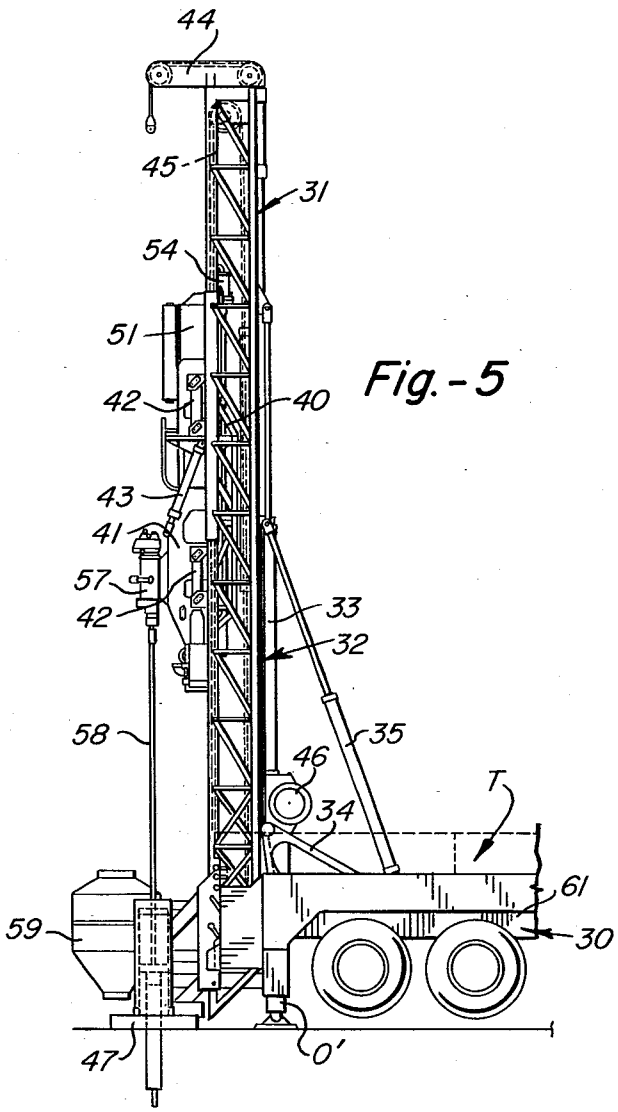
FIG. 5 is a partial side elevational view of the drill rig of FIG. 2 with a jackhammer mounted upon the carrier to connect with drill steel.

The versatility of the improved drill rig R is exemplified in FIGS. 1 to 6 of the drawings. At FIG. 1 a diesel pile driving hammer 50 is mounted in the carrier 41 and a ground shoe 47*a* is connected to the base of the mast 31. At FIG. 2, the diesel pile driving hammer 50 mounted in the carrier connects with a rigid thick-walled pipe 51 to drive it into the earth. At FIG. 3, the lower portion of the pile driving hammer is removed and the rotary drilling head 52 is mounted on the carrier and connected with a drill stem 53. The drill stem extends through a ground shoe 47 connected to the mast 31. A drive motor 54 at the top of this carrier 41 connects with the drilling head as shown. At FIG. 4, a lower portion of the pile driving hammer 50 is removed and a diamond drilling rotary head 55 is mounted on the carrier and is connected to a drill rod 56. The diamond drill head also connects with the drive motor 54. The changes necessary to shift the operation from a pile driver to a rotary type drill are comparatively simple and quickly accomplished without changing the drill rig setup. FIG. 5 shows the pile driving hammer 50 in a place and a jackhammer 57 mounted on the outer face of the carrier 41 and connected with drill steel 58. When the jackhammer 57 is used, the carrier is shifted into its support slide 40 to align the jackhammer steel 58 with the drill alignment of the other drilling mechanisms which are used with the carrier 41 at its rearward outwardly extended position.

At FIG. 6, the same arrangement is used as that shown at FIG. 5 but the mast 31 is tipped to a 45-degree inclination to illustrate the ease at which an inclined hole may be drilled. The only addition is a truncated ground engaging wedge 49' at the underside of the ground shoe 47 to provide good ground contact by the mast 31. Also, it is to be noted that the mast 31 is shifted on the mast slide 32 and by the deck slide to place the base of the mast against the ground and to pull it closely adjacent to the rear end of the deck 30.

Various types of pipe and steel rods may be used with the different drilling mechanisms. A solid pile or a thick-walled pipe is preferred with the pile driver. It may also be used to drive casing into overburden or into a hole drilled by the rotary drill. A standard tubular drill string can be used with the rotary drilling head 52. The jackhammer may be used in conjunction with a rotary drill or with the pile driver, as for exploratory purposes before using a larger drill or driving a pile. Hole alignment is maintained when the carrier 41 is quickly shifted from one position to the other. Also, a dual wall pipe, reverse circulation drilling system is ideal for the rotary drilling head 52 and is especially useful for soil sampling and mineral exploration. This is possible with a simple adaptor as hereinafter described. For convenience, the piles, pipe tubes and steel rods used for drilling may collectively be referred to as "drill pipe means".

The versatility and value of this improved drill rig R is manifest and it is contemplated that drilling may proceed with both water and air as suitable drilling fluids depending upon the type of bit being used. An auxiliary piece of equipment will be a cyclone 59 (FIGS. 3–5) to separate and/or control the discharge of cuttings. As aforementioned, many of the components making up the drill rig R are conventional and need not be described; however, other components mentioned above will now be described in further detail.

The Vehicle Deck 30

Figure 8:
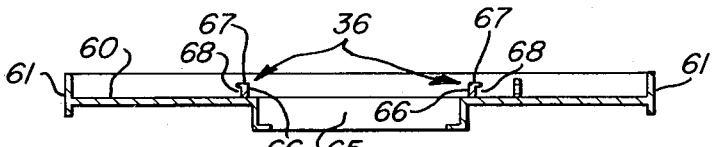
FIG. 8 is a transverse sectional view of the deck as taken from the indicated line 8—8 at FIG. 7.
Figure 7:
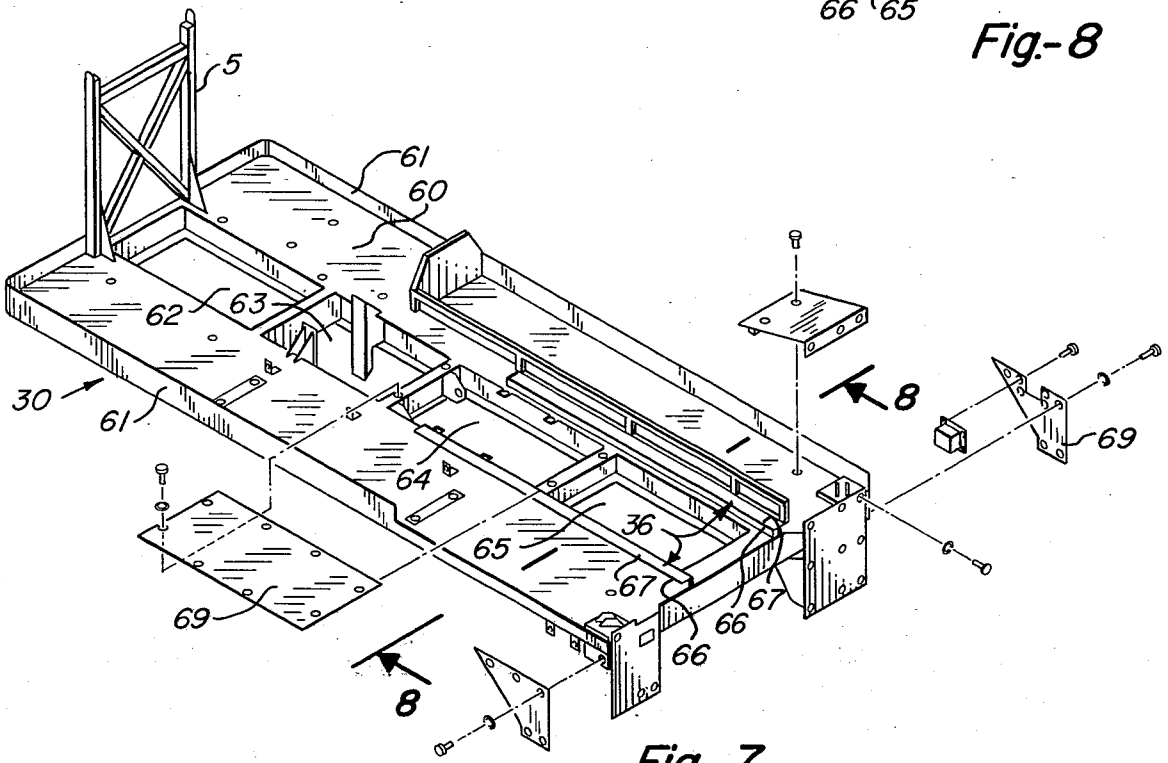
FIG. 7 is a perspective view of the deck which is mounted upon a truck to carry the mast and other components of the drill rig shown at FIGS. 1–6 and with plates and other members connected therewith being shown in an exploded-view relationship.

Referring to FIGS. 7 and 8, the deck 30, which is mounted upon the bed frame of the truck T, comprises a flat, horizontally disposed deck plate 60 having a peripheral flange 61 to provide a retainer lip to better hold items thereon. The strut support S for holding the mast when it is lowered upstands from the front edge of this deck plate 60. The deck plate is reinforced by a structural frame at its underside which is not shown and has a longitudinal central row of openings 62, 63, 64 and 65 and the longitudinal guideways 36 which carry the deck slide 34 are positioned at opposite sides of the rearward openings 64 and 65. The guideways are L shaped members having spacer flanges 66 upstanding from the deck plate 60 and outwardly extending guide flanges 67 at the top of the spacer flanges. The spacing between the guide flanges 67 and the deck plate surface defines laterally, outwardly-facing grooves 68. Other components which are attached to the deck will include a deck cover plate, sliding brackets and end plates, all of which are generally indicated as 69. A suitable bracket means, not shown, will be attached to the deck and to a cylinder means, also not shown, for moving the deck slide 34 along the guideways 36.

The Deck Slide 34

Figures 9, 10:
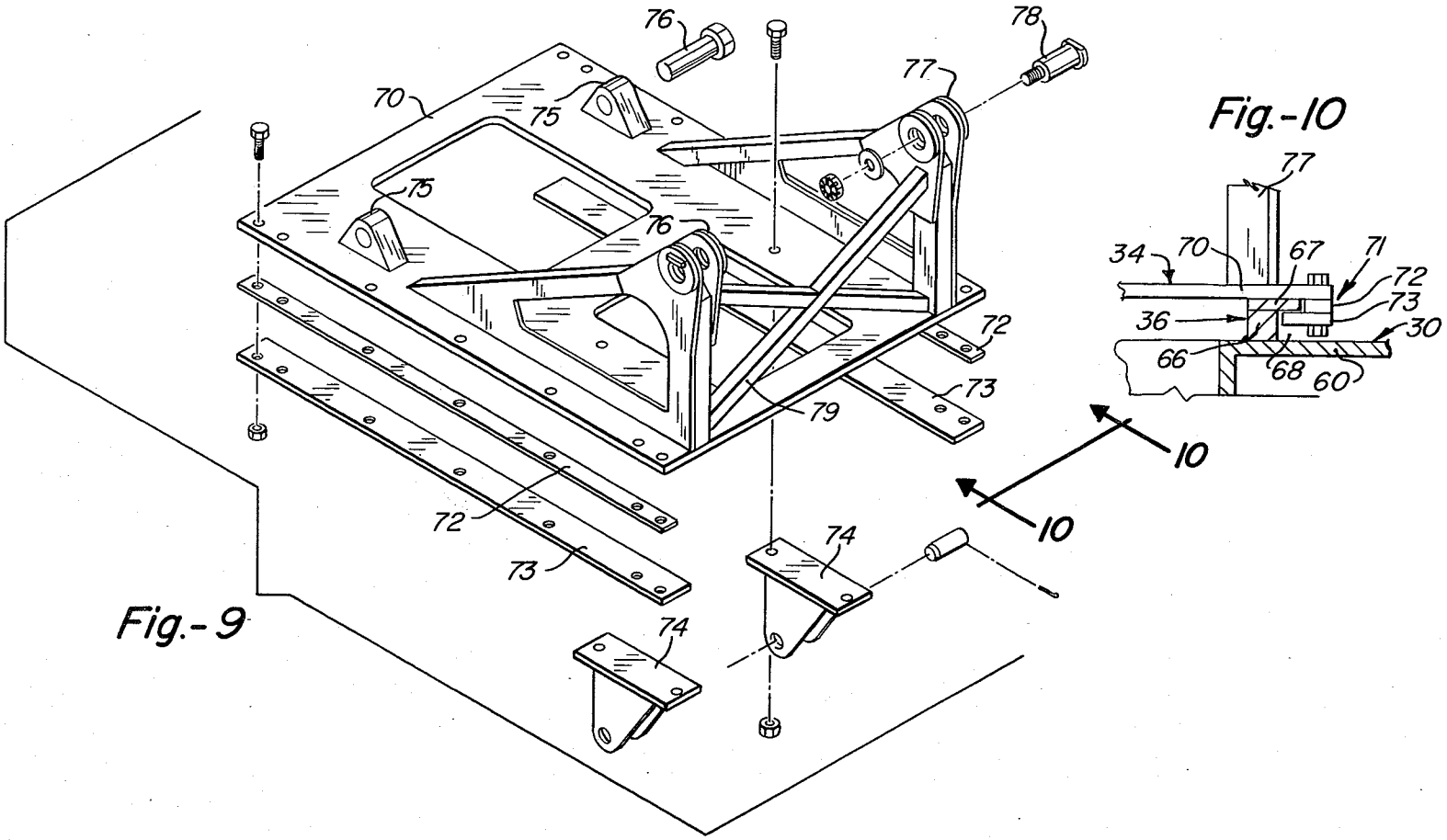
FIG. 9 is an exploded perspective view of the deck slide which is slidably mounted upon the rearward portion of the deck shown at FIG. 7.
FIG. 10 is an enlarged fragmentary detail of a corner portion of the deck slide as viewed from the indicated line 10—10 at FIG. 9 and also a sectional view of a fragment of the deck to illustrate the slide connection between the two components.

Referring to FIGS. 9 and 10, the deck slide 34 comprises a rectangular flat slide plate 70 which is connectively mounted upon the guideways 36 of the deck 30 for longitudinal movement thereon. The width of the plate 70 is slightly greater than the spacing of the opposing guideways 36 and an opposing, mating guideway is formed at the underside of, and at each side edge of the plate 70. Each guideway 71 is L shaped and is formed by bolting a spacer strip 72 and a flange strip 73 to the underside of the plate 70 to mesh with the strips 66 and 67 of the respective guideway 36 as best shown at FIG. 10. Yoke brackets 74 are affixed to the underside of the slide plate 70 and are connected to the cylinder, heretofore mentioned but not shown, which will forcibly shift the deck slide 34 forwardly and rearwardly along the guideways 36 of the deck 30.

A first pair of laterally spaced, upwardly extending pivot mount brackets 75 are affixed to the front end portion of the slide plate 70. These brackets connect with the lower ends of the hydraulic cylinders 35 as with pins 76. The cylinders 35 also connect with the mast slide 32 to raise and lower the mast slide 32 and the mast 31 as heretofore described. A second pair of laterally spaced upwardly extending pivot mount brackets 77 are affixed to the rear end portion of the slide plate 70 for pivot connection with the lower end of the mast slide 32, as with pins 78. The mast slide and the mast 31 will swing about the pivots of the brackets 77 as from a vertical position to a nearly horizontal position over the truck and upon the strut support S at the front of the deck 30. Accordingly, the brackets 77 must extend upwardly above the slide plate 70 a distance sufficient to hold the lowered mast above equipment on the deck. This distance will be several feet and accordingly, the brackets 77 are reinforced with suitable cross struts 79.

The Mast Slide 32

Figure 12:
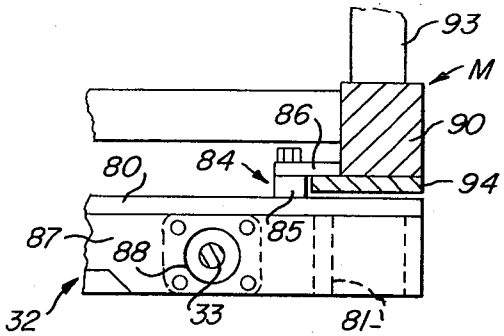
FIG. 12 is an enlarged fragmentary detail of a corner portion of the mast slide, as viewed from the indicated line 12—12 at FIG. 11, and also a sectional view of a fragment of the mast to illustrate the slide connection between the two components.
Figure 11:
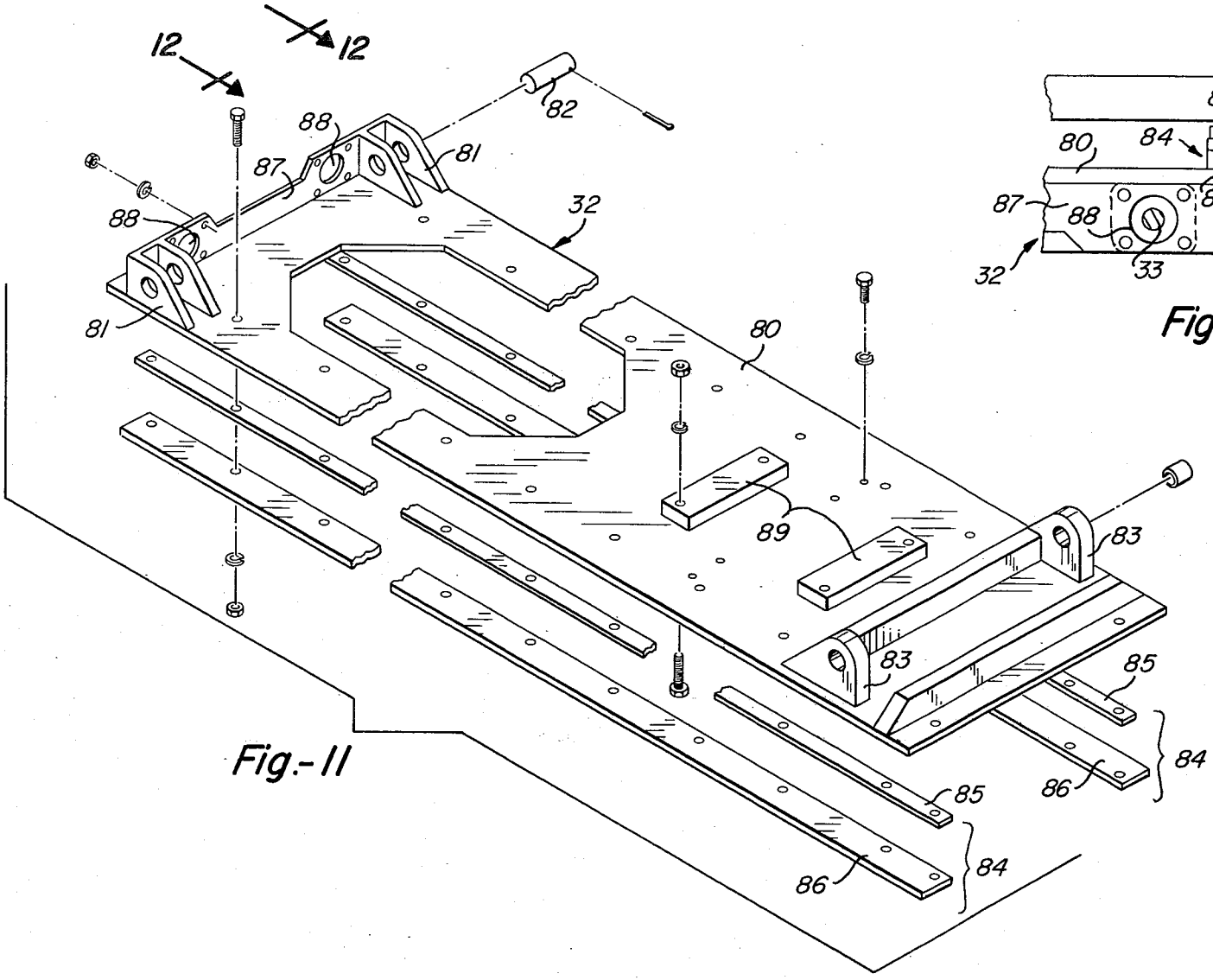
FIG. 11 is an exploded perspective view of the mast slide which is pivotally mounted on the rearward end of the deck slide shown at FIG. 9.

Referring to FIGS. 11 and 12, the mast slide 32 comprises a rectangular carrier plate 80 which is pivotally connected to the pivot mount brackets 77 of the deck slide 34 to swing from a vertical position to a nearly horizontal position as heretofore mentioned. Describing the mast slide as in its vertical position, a first pair of laterally spaced, forwardly outstanding pivot mount brackets 81 are affixed to the upper end of the plate 80 for pivotal connection with the upper ends of the power cylinders 35. The brackets 81 connect with the cylinders 35 as with pins 82. A second pair of laterally spaced, forwardly outstanding pivot mount brackets 83 are affixed to the lower end portion of the plate 80 for pivotal connection with the rearwardly upstanding pivot mount brackets 77 of the deck slide 34 as with pins 78, heretofore described.

To connect the mast slide 32 with the mast 31 a pair of outwardly opposing guideways 84 are located near the side edges of the rear face of the carrier plate 80. Each guideway is an L shaped member formed by a spacer strip 85 and a flange strip 86 bolted to the plate as shown at FIG. 12. The cylinders 33, which shift the mast on the slide, are connected to a transverse shelf plate 87 located at the top of the front face of the carrier plate 80. The shelf plate merges with and is reinforced by the brackets 81 and a pair of passage holes 88 are located in this shelf plate 87 through which the pistons of cylinders 33 extend when the cylinders are bolted to the shelf plate. To complete the mast slide assembly, a pair of mounting blocks 89 are provided at the center, lower portion of the forward face of plate 80, with one being above the other. The drum hoist winch 46 is mounted upon these blocks 89.

The Mast 31

Figure 13:
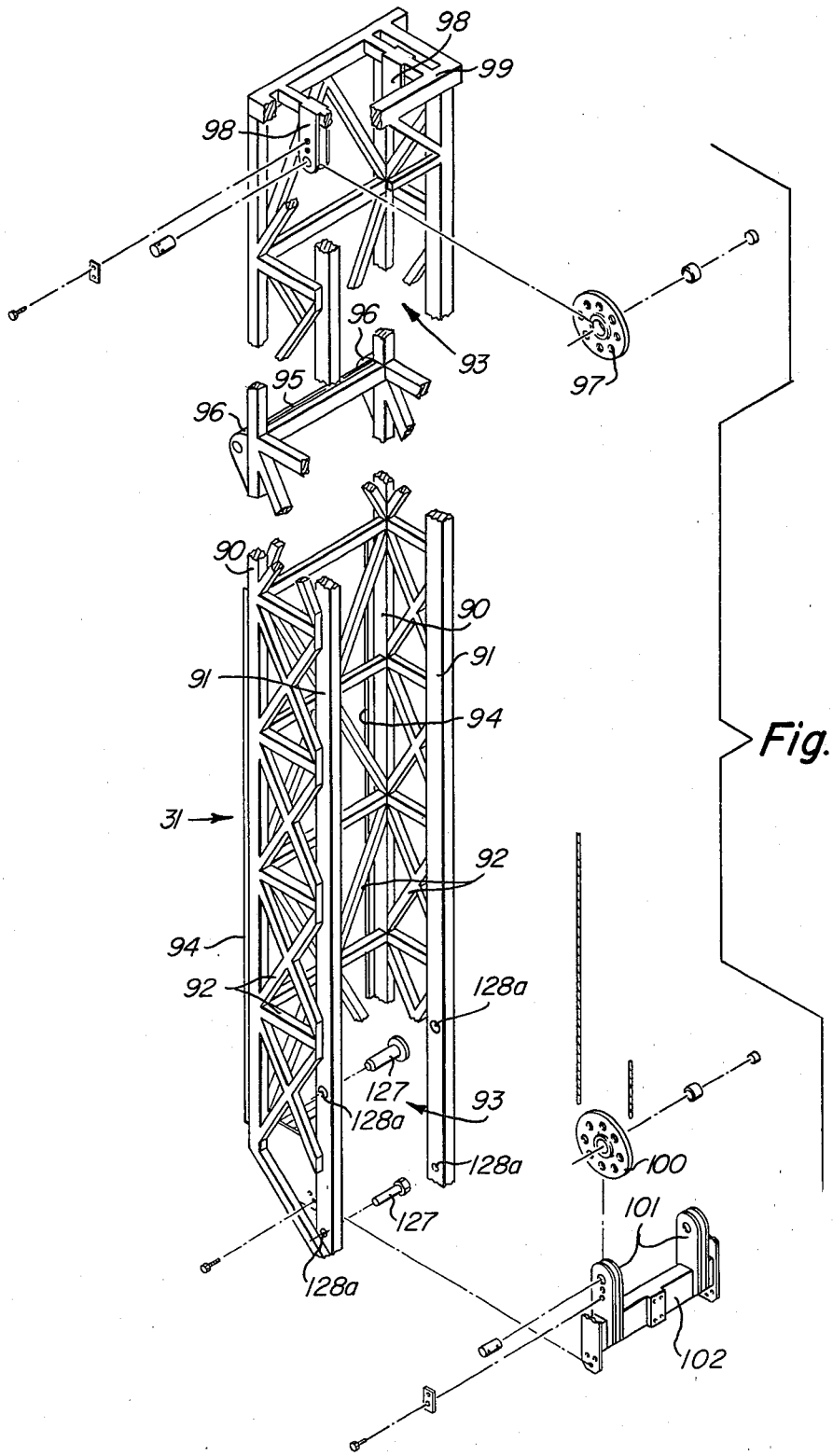
FIG. 13 is a perspective view of the mast which is slidably mounted on the mast slide shown at FIG. 11 with portions broken away to conserve space and with lifter-downpull components associated therewith.

Referring to FIG. 13, the mast 31 comprises an elongated framework, rectangular in section, having pairs of laterally spaced front and rear facing elongated cord members 90 and 91, respectively. The cord members are spaced and rigidly connected by bracing struts 92 at the forward face and at the sides of the mast, leaving the rearward face open to define a slot means 93 wherein the slide frame 40 is mounted as heretofore mentioned. This mast 31 includes a slide bar 94 affixed to the forward edge of each front cord member 90, and each slide bar 94, located at the lower section of the mast, fits into a respective guideway 84 of the mast slide 32 as best shown at FIG. 12. The mast also includes a cross plate 95 which is transversely affixed to the forward edge of the forward cord members 90 at a suitable location above the slide bars 94. The cross plate 95 carries a pair of laterally spaced, forwardly extending pivot mount brackets 96 for connection with the piston of the cylinder 33 as heretofore mentioned.

Figures 18, 19:
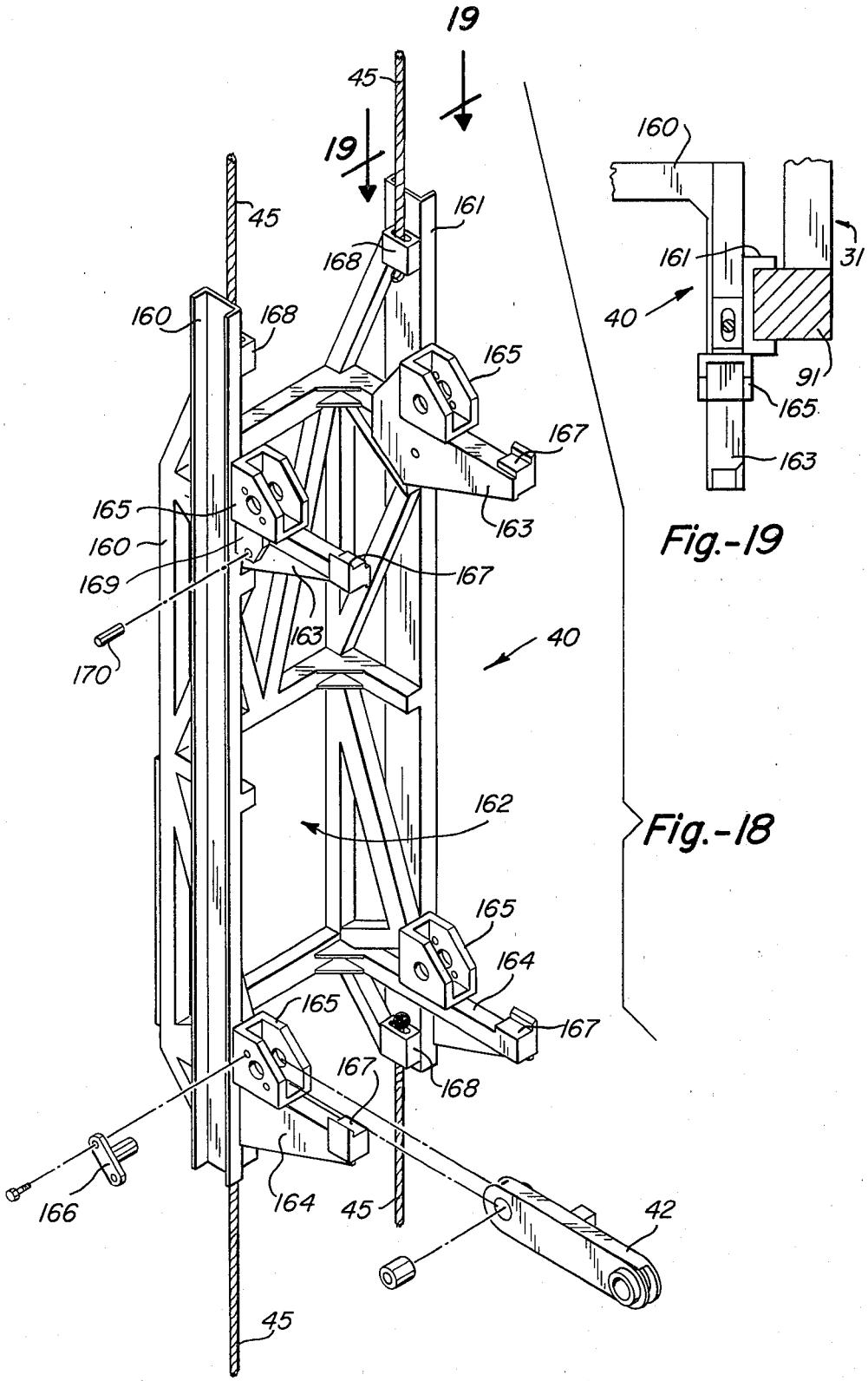
FIG. 18 is a perspective view of a carrier slide frame which is slidably mounted on the mast shown at FIG. 11, with a link and other components associated therewith being shown in exploded-view relationship.
FIG. 19 is an enlarged fragmentary corner portion of the carrier slide frame, as viewed from the indicated line 19—19 at FIG. 18 and also a sectional view of a fragment of the mast to illustrate the slide connection between the two components.

The lifter-downpull cables 45 are located within this mast 31 to connect with the slide frame 40 and are also shown at FIG. 18 connecting with the slide frame 40. The lifter portions of the cables are threaded over a pair of laterally spaced upper pulleys 97 (only one being shown). The pulleys are mounted in suitable brackets 98 suspended from top cross brace members which form the crown 99 of the mast. The downpull portions of the cables 45 are threaded about a pair of laterally spaced lower pulleys 100 (only one being shown). The pulleys 100 are mounted in suitable upstanding brackets 101 which are affixed to a cross bar 102 connecting with the bottoms of the rear cord members 91. The various details as to how the cables 45 are operated and controlled by the operator are not shown. They are actuated by a pair of cylinders and a sheave arrangement in a conventional manner.

The Pipe Handling Boom 44

Figure 15:
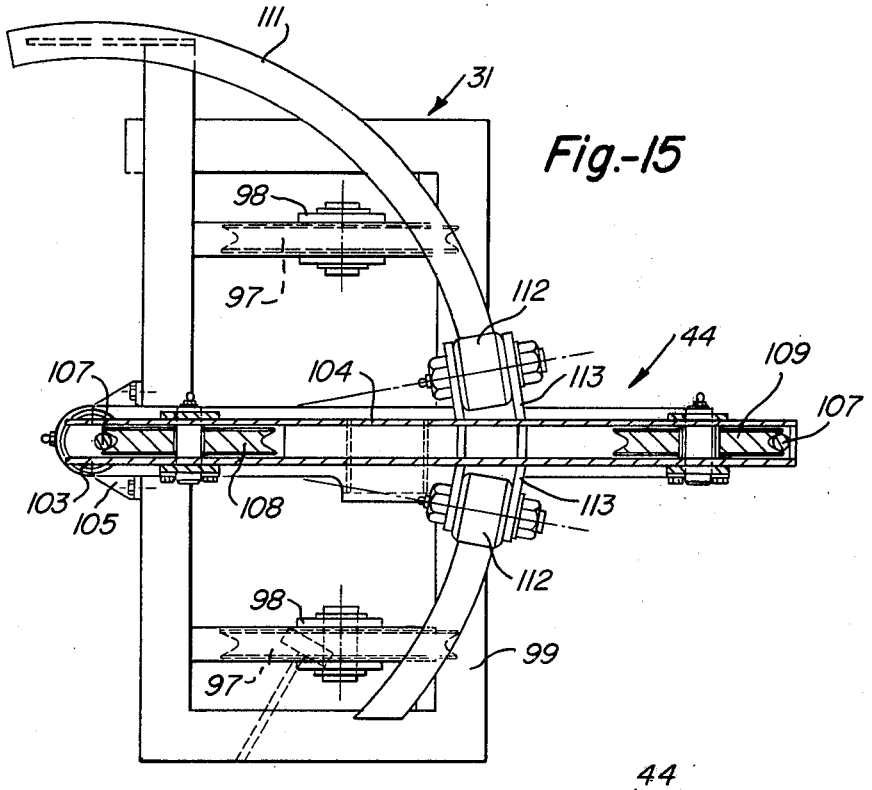
FIG. 15 is a plan view of the boom of FIG. 14.
Figure 14:
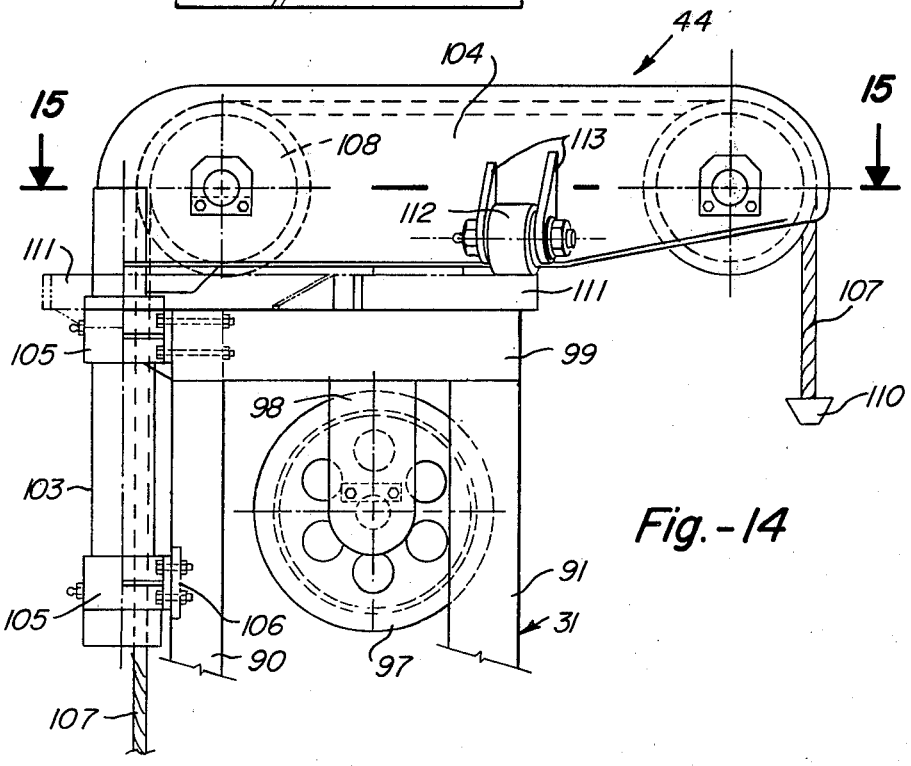
FIG. 14 is an enlarged side elevational view of the top portion of the mast of the drill rig of FIGS. 1–6 showing a pipe handling boom mounted thereon.

Referring to FIGS. 14 and 15, the crown block 44 is an L shaped member which includes a vertical tubular sleeve 103 and a horizontal, narrow upright pulley case 104 at the top of the sleeve. The vertical sleeve 103 overhangs the forward face of the mast and is secured thereto, adjacent to the crown of the mast 31, by a pair of pivot collars 105 secured to transverse plates 106 attached to the forward face of the mast. The pulley case 104, extending from the top of the sleeve, will normally extend rearwardly over the mast crown 99 to cantilever a short distance therebeyond. The crown block 44 may thus swing from its normal rearward alignment, about the sleeve axis, and to a position at the side of the mast. A cable 107 extends upwardly from the hoist 46 at the forward face of the mast and into the sleeve 103. The cable turns thence about a first pulley 108 within the case 104 to extend horizontally to a second pulley 109 at the rearward end of the case, to turn about this pulley 109 and extend downwardly at the rear of the mast. The end of the cable carries a weighted head 110 and various tools such as a pipe attachment collar may also be fastened to the end of this cable.

To better handle loads on the cable 107, the pulley case 104 is supported upon a radially curved track 111 mounted upon the mast crown 99. A track engaging roller 112 is mounted in suitable brackets 113 at each side of the pulley case. The track is suitably extended about the side of the mast 31 opposite to the operators console C to permit the boom to swing fully 90 degrees from the normal rearward position to permit the cable to be directly over pipes and other items normally carried at that side of the mast.

The Breakout Ground Shoe

Two types of ground shoes are attached to the mast, a breakout ground shoe 47, FIGS. 3 to 5, for the rotary drill 52 and other drills and a puller ground shoe 47*a*, FIGS. 1 and 2, for the pile driver, which will be hereinafter described.

Figure 3:
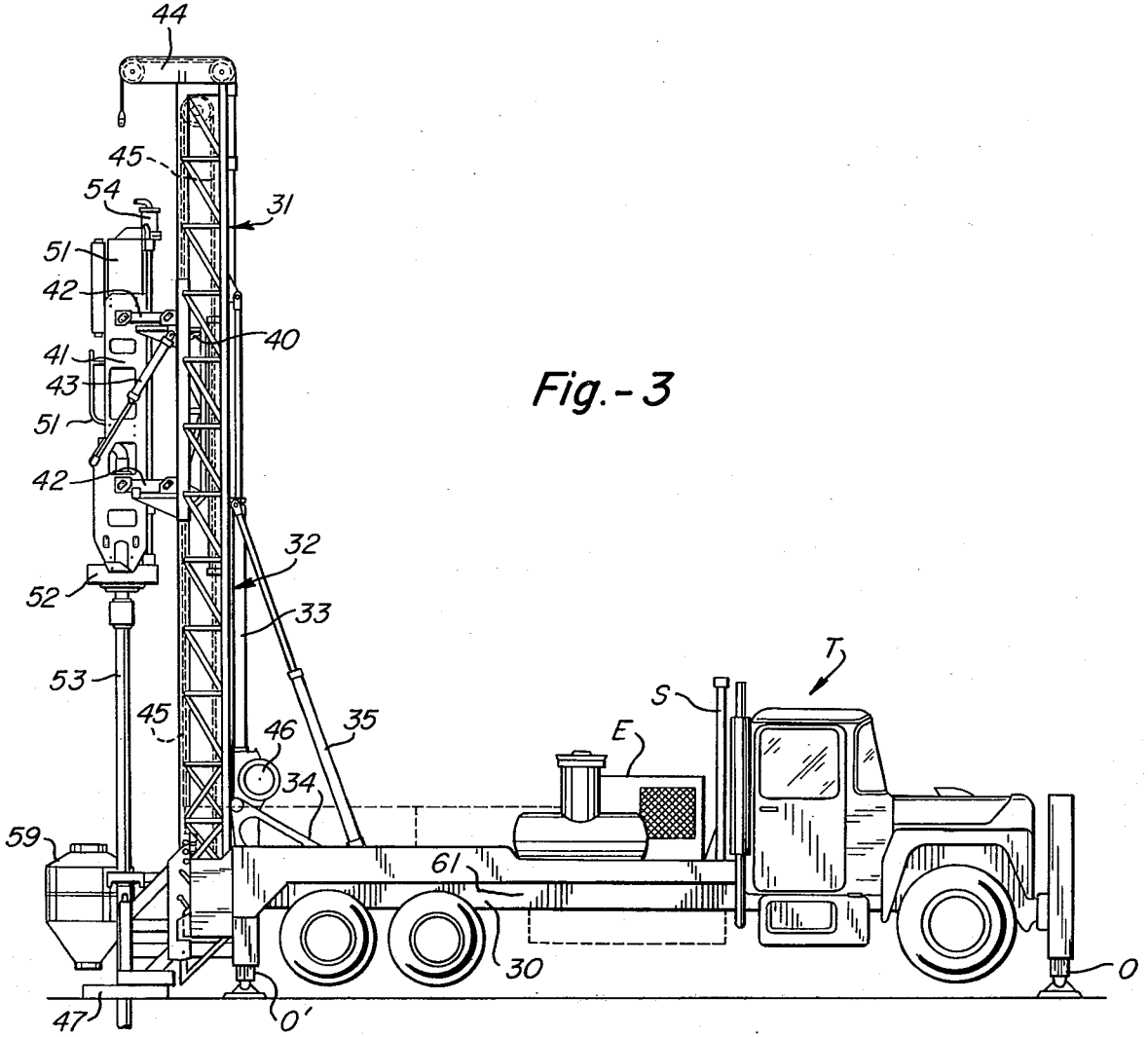
FIG. 3 is an opposite side elevational view of the drill rig shown at FIG. 2 but with a rotary drill head, as for a rotary drilling, being mounted upon the carrier to connect with a string of drill pipe.
Figure 4:
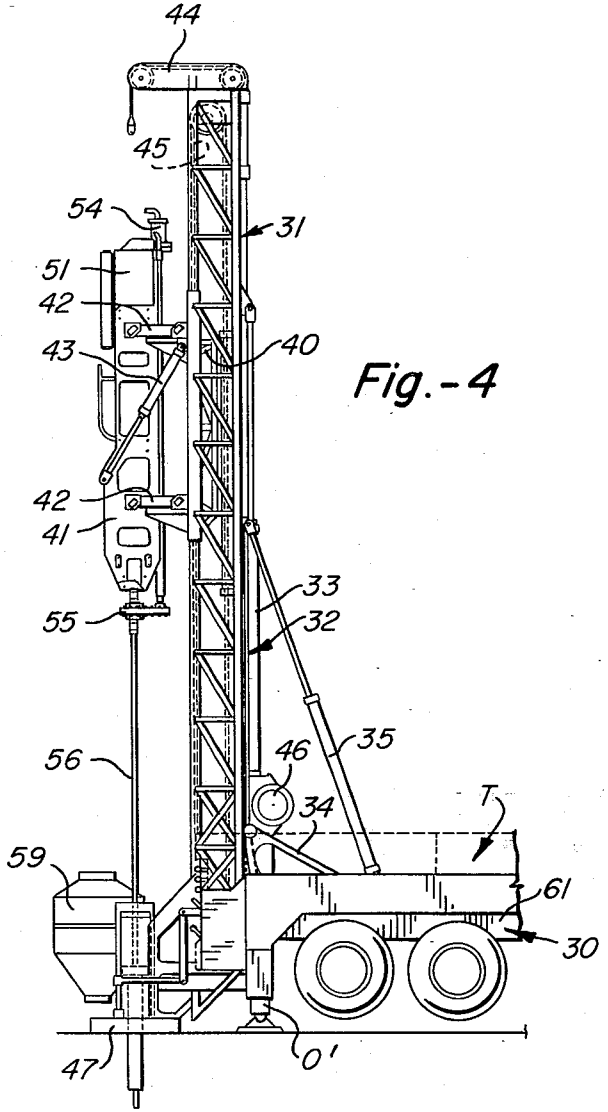
FIG. 4 is a partial side elevational view of the drill rig of FIG. 2 but with a rotary diamond-bit drill head mounted upon the carrier to connect with a diamond drill rod.
Figure 16:
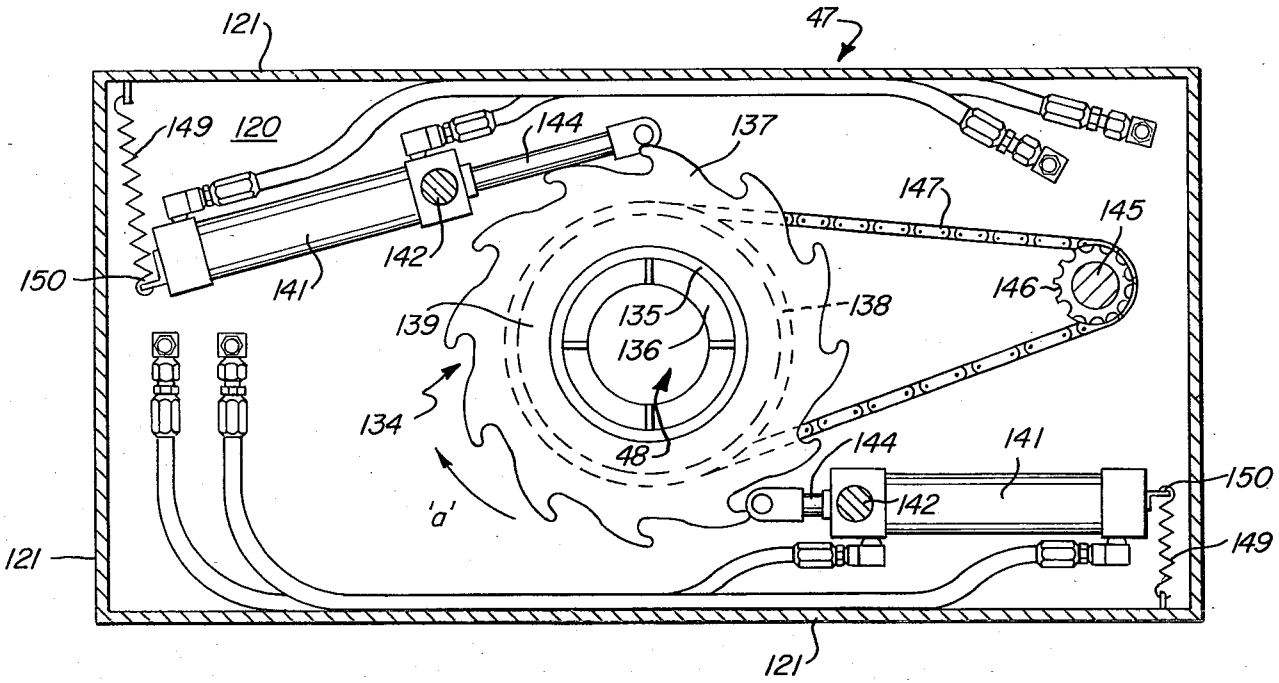
FIG. 16 is an enlarged underside, or bottom, view of a drill pipe breakout mechanism within a ground shoe connected to the bottom of the mast, but with a cover plate and other parts removed, to illustrate the components of the drill pipe breakout mechanism.
Figures 17, 17A:
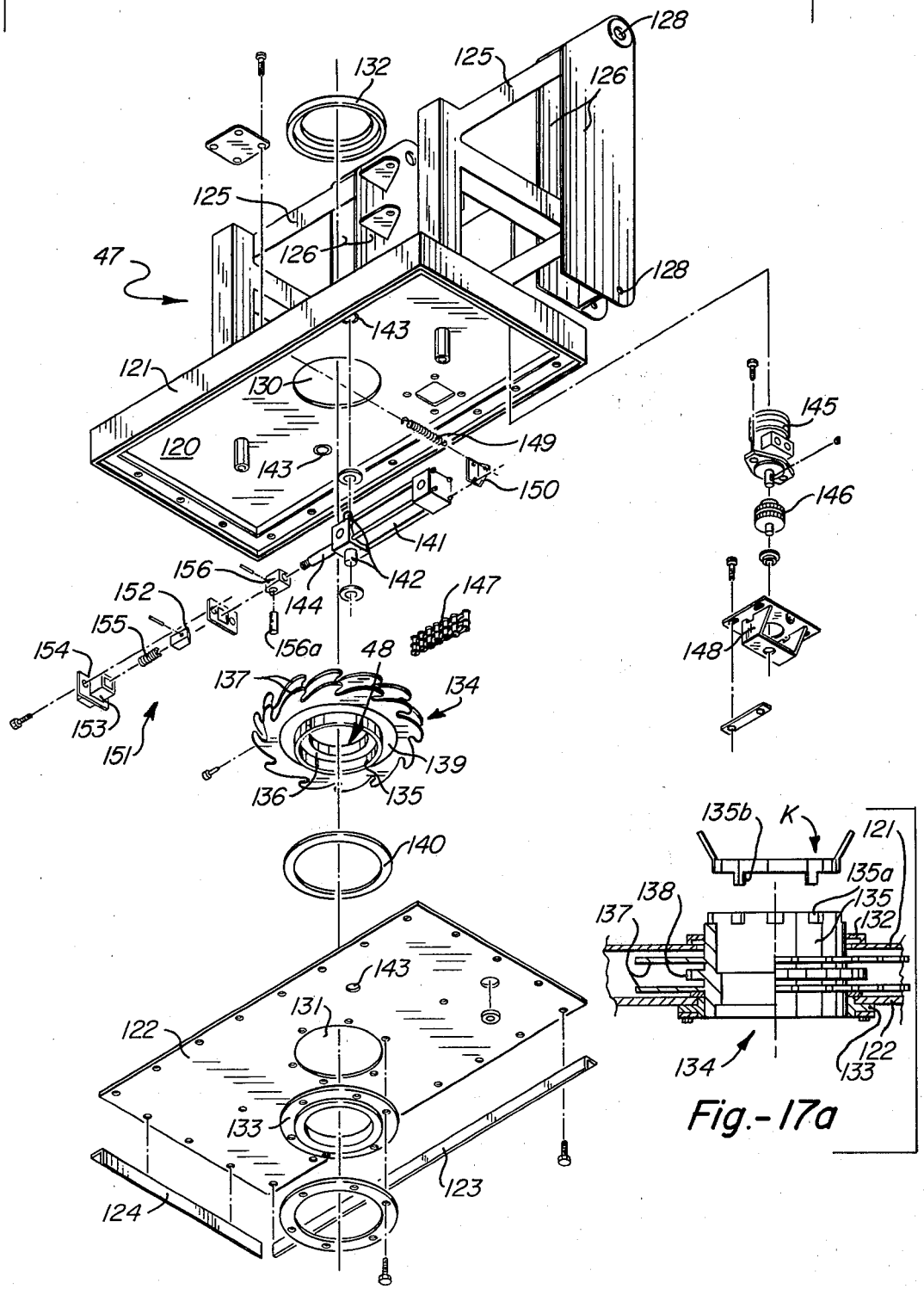
FIG. 17 is an exploded perspective view of the ground shoe and the drill pipe breakout mechanism therein and 17*a* is a sectional elevational view of the center portion of the ground shoe breakout mechanism and also an elevational view of a C-clamp to lock the end of a pipe section onto the breakout mechanism.

Referring to FIGS. 3, 16 and 17, the ground shoe 47, having a breakout means within it is formed as a flat, comparatively shallow rectangular housing having an upper plate 120, sidewalls 121 depending therefrom and a bottom cover plate 122 which is bolted to the lower edges of the sidewalls. Downwardly depending flanged feet members 123 and 124 are attached to the undersurface edges of the bottom cover plate (only two feet members being shown). This ground shoe is connected to the lower end of the mast 31 to outstand rearwardly therefrom by a spaced pair of upwardly inclined strut frames 125 affixed to the upper plate 120 for attachment to the lower ends of the rear upright mast cords 91. Each strut frame 125 has opposing upright, connective shoe plates 126 which embrace its respective mast cord 91 and is secured thereto by pins 127 (FIG. 13) fitting into holes 128 in the shoe plates and registering holes 128*a* in the mast cord members.

So attached to the mast, a drill stem 53 projected from a drill 52 carried on the mast will extend through the pipe passageway 48 at the center of the ground shoe 47. The upper plate 120 and the bottom plate 122 are provided with aligned central openings 130 and 131, respectively. An upper protective cover ring 132 is mounted in the upper plate opening 130 and a lower wear ring bearing 133 is mounted in the lower plate opening 131. A breakout drive wheel 134 includes a central tubular shaft 135 mounted in and between the ring bearings 132 and 133. A bushing 136 is fitted within the tubular shaft 135 to guide a drill pipe or drill stem. A pair of toothed, one way ratchet wheels 137 having a sprocket 138 between them (as shown in dotted lines at FIG. 16) are fitted about the shaft 135. A thrust collar 139 about the shaft 135 at the underside of the lower ratchet wheel engages a thrust bearing 140 at the lower ring bearing 133.

When a drill pipe string, or a drill stem, is being raised from a hole, the top portion of the uppermost pipe section of the string within the hole will extend through the passageway 48 of the shoe 47. The uppermost pipe section is then lifted out of the hole, to be gripped by tongs and the next pipe section will be held by a C-collar K by embracing flats near the top end of the pipe. The C-collar K, in turn, is held by the shaft 135 of the breakout drive wheel 134. To accomplish this, the shaft 135 is capped by a circular array of castellation slots 135*a* and the C-collar K includes lugs 135*b* depending from the collar to fit into the castellations, all as best shown at FIG. 17*a*.

With this arrangement, the aforesaid next pipe section in the stem will be forcibly rotated to first break the grip of the threads between the two pipe sections and then rapidly rotated to disconnect the sections. To forcibly rotate the drive wheel 134, a pair of hydraulic cylinders 141 are mounted within the shoe cavity on trunion pivots 142 outstanding from opposite sides of the head of each cylinder to be fitted into bearing sockets 143 in the upper plate 120 and the bottom plate 122. The end of the reciprocal piston rod 144 of each cylinder 141 is drivably engageable with a ratchet wheel 137 to produce high torque rotation of the wheel. The two cylinders 141 are spaced at opposite sides of the drive wheel 134 to have their pistons 144 engageable with the ratchet wheels to rotate the drive wheel 134 in the direction of the indicated arrow 'a' at FIG. 16. After the thread connection is broken, the pipe may then be rapidly rotated to disconnect it from the pipe above by an hydraulic motor 145 mounted in the ground shoe 47, having its drive shaft carrying a sprocket 146 which is connected to the sprocket 138 between the ratchets by a chain 147. A bracket 148 holds the motor 145 and its sprocket 146 in place. Once the hydraulic motor 145 takes over, hydraulic pressure remains in each cylinder to prevent the retraction of its piston rod.

The two cylinders 141, carried on pivots 142, are positioned to maintain a generally tangential driving engagement with the ratchet wheels 137 during extension of their pistons 144. In retraction, they will swing past the teeth of the ratchet wheels 137. A tension spring 149 at each cylinder is connected between a sidewall portion 121 of the shoe 47 and a bracket 150 at the back end of the cylinder to bias the cylinder to a position of driving engagement with its ratchet wheel 137.

A latching device 151 is associated with each piston 144 to hold the cylinder rod end away from the sprocket when it is rotating. A latch 152 having an inclined face is slidably mounted in an opening 153 in an end block assembly 154. The block assembly is suitably mounted in the shoe housing. The latch is biased by a spring 155 to a rod engaging position when the piston rod 144 is fully extended. This piston rod 144 terminates as a head 156 which includes a grip pin 156*a* extending from opposite sides of the head. Thus, the head lies between the sprocket members 137 and pin 156*a* grips the valleys of the sprocket teeth. When the piston is fully extended, it engages the inclined face of the latch 152 and is thereby held away from the sprocket teeth. As soon as the piston 144 commences to retract into its cylinder 141, it moves away from the latch 152 and against the sprocket teeth responsive to the bias of the spring 149.

The Slide Frame 40

Referring to FIGS. 18 and 19, the slide frame 40 is formed as a rectangular, upright trough-shaped framework 160 having an open face at its rearward side. An upright slide channel 161 is affixed to each side of this framework. The slide frame is mounted in the slot cavity 93 of the mast 31 with the slide channels 161 lying against and embracing the upright rear cords 91 of the mast and thus, these rear cords 91 define a slide means whereon the slide frame is mounted. The rearward open face of the framework provides a pocket 162 whereinto the drill carrier 41 may swing as heretofore described (see FIG. 5).

Upper arm braces 163 and lower arm braces 164 outstand rearwardly from each side at the top and bottom of this framework 160. A pivot support bracket 165 is mounted upon each arm 163 and 164 adjacent to the slide channel 161 and each bracket pivotally connects with a link 42 which also extends rearwardly from the bracket to connect with the drill carrier 41 as heretofore described. The pivotal connection is with a pin 166. A pad 167 is located at the extended end of each arm brace 163 and 164 to engage the link 42 in the bracket 165 mounted on the arm brace whenever the link is extended rearwardly horizontally.

A cable socket 168 is located near the top and near the bottom of each slide channel 161 and the lifter-pull-down cables 45 extend into their respective sockets to connect with the slide frame. To complete the slide frame, a pivot bracket 169 is associated with each upper arm brace 163 for connection by a pin 170 with the cylinder 43 which swings the drill carrier 41 from a rearwardly extended position to a retracted position in the pocket 162.

The Drill Carrier 41

Referring to FIG. 20, and FIGS. 1 to 5, the carrier 41 is a versatile unit capable of holding a pile driver 50, a rotary drill 52, a diamond drill 55 and a jackhammer 57 as heretofore described. The pile driver installation will be described first since the pile driver 50 will ordinarily remain on the carrier when other components are used as indicated at FIGS. 2 to 6. A conventional diesel pile driver, such as manufactured by the FMC Corporation and described in its Operators Manual 1174, is preferred. This is an elongated, generally rectangular unit having suitable mounting holes 175 at both sides. A specially arranged drive anvil 176 and a drive spout 177 are mounted at the bottom of the hammer for connection with a pile or a thick-walled pipe 51 as further described.

The carrier 41 comprises a pair of laterally-spaced, elongated side plate members 178R and 178L which are affixed to the sides of the pile driver in spaced parallelism by suitable bolts fitting into holes **175*a* which register with holes 175 in the pile driver and which are also held apart, and in spaced parallelism by a stiffener tube 179. The outer face of each plate 178 includes a pivot support bracket 181 at an upper position and at a lower position to receive the outward ends of the upper and lower links 42, extending from the slide frame 40, and the links 42 pivotally connect with the brackets 181 by pins 182. A post 183 outstands from the rearward edge of each plate 178 near the lower bracket 181 to connect with the hydraulic cylinder 43. The linkage-cylinder mechanisms swing the carrier 41 into the pocket 162 of the slide frame 40** as heretofore described.

The lower portions of the side plate members 178 project below the pile driver and mounting holes 184 are provided to register with mounting holes **184*a* in flanges of the drive anvil as hereinafter described. A flat, reinforced tongue 185 depends from the lower edge of each side plate 178 and the tongues fit into spaced sleeves 186 on the drive spout and other components as hereinafter described. A spaced, hooked catch plate 187 at the outward side of each sleeve 186** holds the drive spout, or other components, in place.

A supplemental drive system is provided at the forward edge of the side plate 178R. The hydraulic motor 54 is mounted at the top of the pile driver on a drive shaft housing plate 188, on a support plate 189 and a drive shaft 190 depends therefrom, through bearings 191 secured to the forward edge of side plate 178R to the bottom of the side plate. The shaft connects with rotary drilling heads 52 and 55, hereinafter further described.

The Drive Anvil 176 and Spout 177 of the Pile Driver

Figure 21:
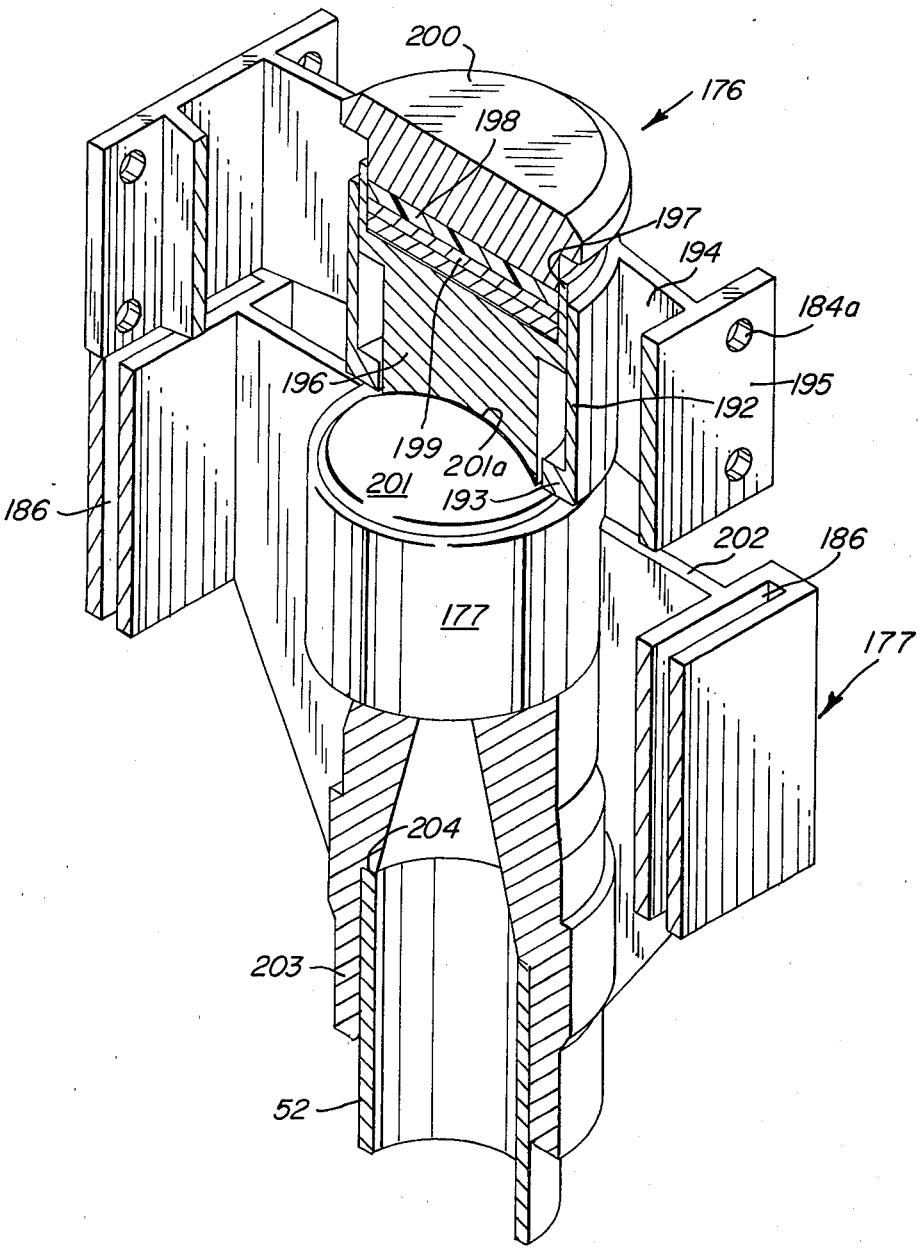
FIG. 21 is an enlarged perspective, sectional view of a drive anvil and spout which are mounted on the carrier frame with the pile driver to connect with a pile or pipe.
Figure 23:
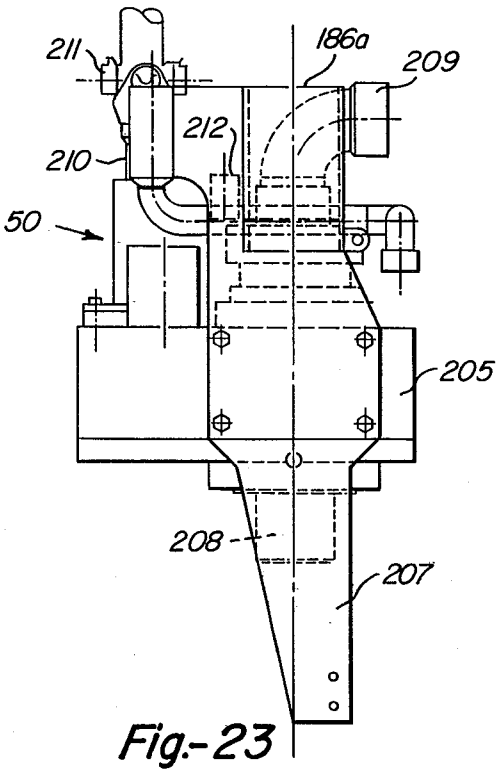
FIG. 23 is another side elevational view of the apparatus of FIG. 22.
Figure 22:
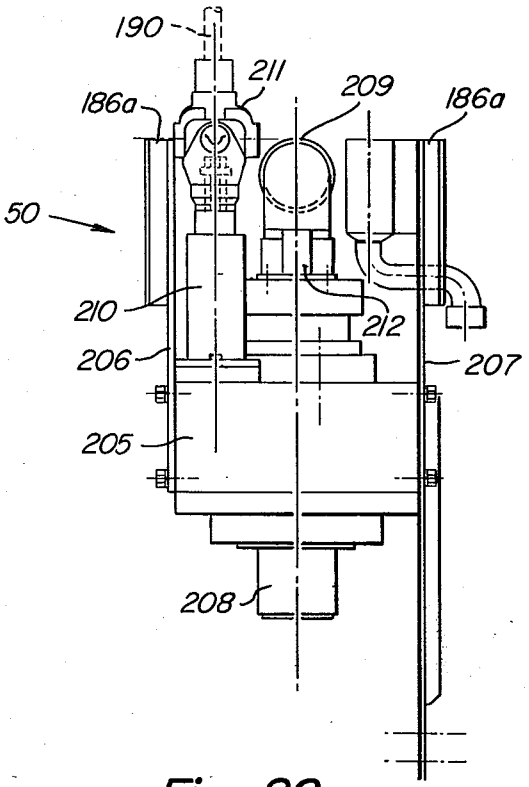
FIG. 22 is a side elevational view of a rotary drill head adapted to be held at the base of the carrier frame shown at FIG. 20.

Referring to FIG. 21, the drive anvil 176 is carried within a cylindrical housing 192 having an inset shoulder 193 at its base, lateral plate-like arms 194 holding diametrically opposing mounting plates 195 wherein mounting holes **184*a* are located to secure the anvil to the side plates 178R and 178L as heretofore described. Within this housing a spout head 196 is mounted having a lower cylindrical stem projecting downwardly through the shoulder 193 and an upwardly projecting head terminating as a cap 197 wherein plastic and metallic discs 198 and 199 are placed. The discs are topped by a cap 200** which engages the pile driver hammer.

The spout 177 is a solid cylindrical member having a spherical convex top surface 201 mating with a spherical concave surface **201*a* at the underside of the head 196. The spout has lateral plate-like arms 202 holding the diametrically opposing sleeves 186 which receive the tongues 185 of the side plate members 178R and 178L. The socket 203 of the spout receives the pipe 52 with an end shoulder 204 to abut against the end of the pipe 52** as it is being driven into the earth.

The Rotary Drill Head 52

Referring to FIGS. 3, 22, 23, 24 and 25, the rotary drill head 52, shown by these figures, may be installed on the tongues 185 by removing the pile driver spout 177. Once installed, the drill head 52 is connected with the drive shaft 190. The drill head is built about a gear box 205 with mounting side plates 206 and 207 connected to the box to form sleeves **186*a* to receive the tongues 185 of the carrier side plates 178R and 178L** so that the drill head is carried by these plates.

The output shaft 208, which connects to the drill stem 53, extends through the gear box and the passageway through this shaft connects with an elbow 209 at the top of the gear box for fluid flow therethrough. The input to the gear box 205 is through an upward extension 210 with a universal coupling 211 at the top of the extension connecting with the drive shaft 190. A lug 212 on the gear box 205 is positioned adjacent to the elbow 209 for connection with the lift cable 107.

Figure 24:
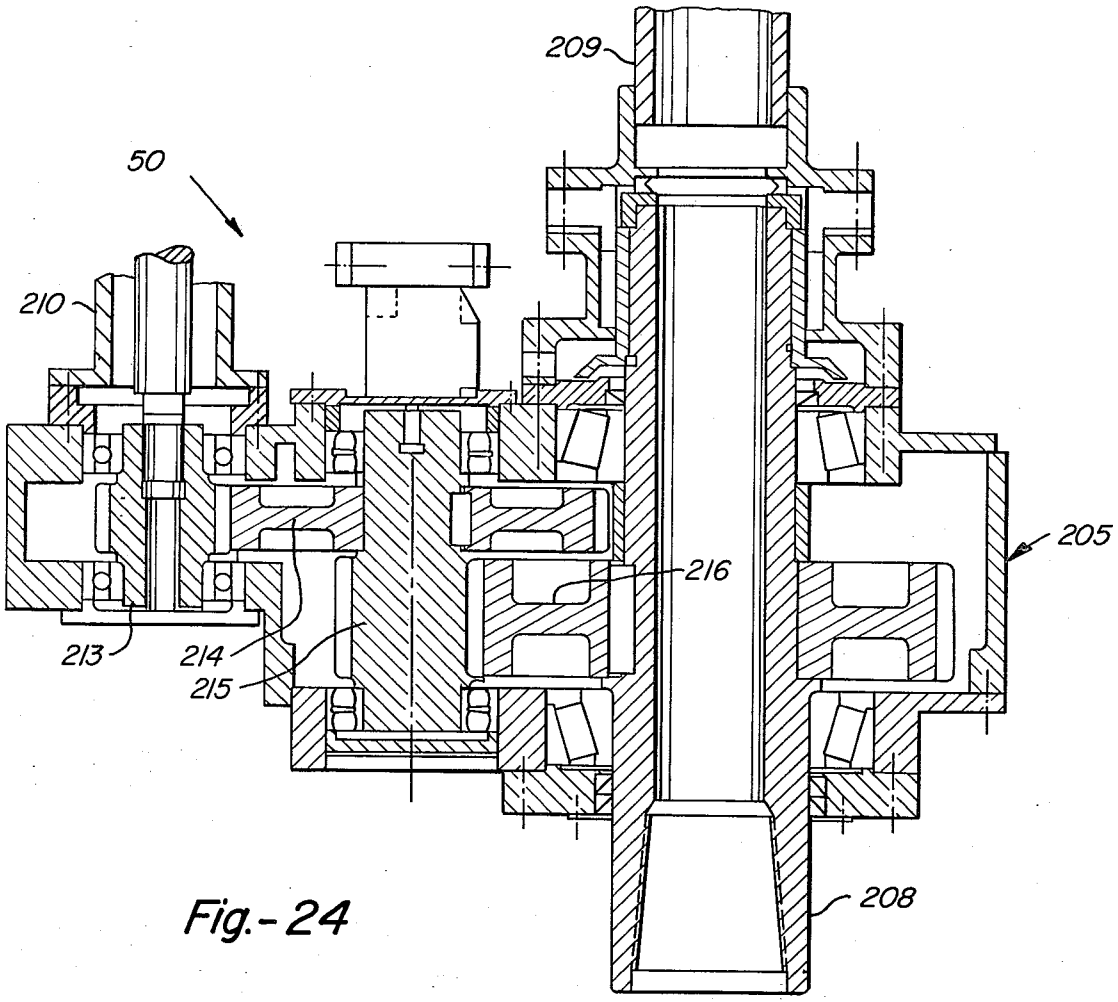
FIG. 24 is a cross sectional view, on an enlarged scale, of the gear box of the rotary drill head shown at FIG. 22.

Referring to FIG. 24, the gear train within the gear box 205 is selected to provide a slower high torque rotation of the output shaft 208, responsive to high speed rotation of the drive shaft 190. The gears include an input pinion 213 connecting with the shaft of extension 210 which connects with drive 190. An intermediate gear 214 is mounted on a pinion shaft 215. The pinion of shaft 215 engages an output gear 216 which is keyed to the output shaft 208. This output shaft is comparable in diameter to the drill pipe 53 and the opening at the base is internally threaded with a tapered thread for the pipe connection. Suitable seals, keys and bearings hold the various pinions and gears in place, all of which are conventional and need not be further described.

Figure 25:
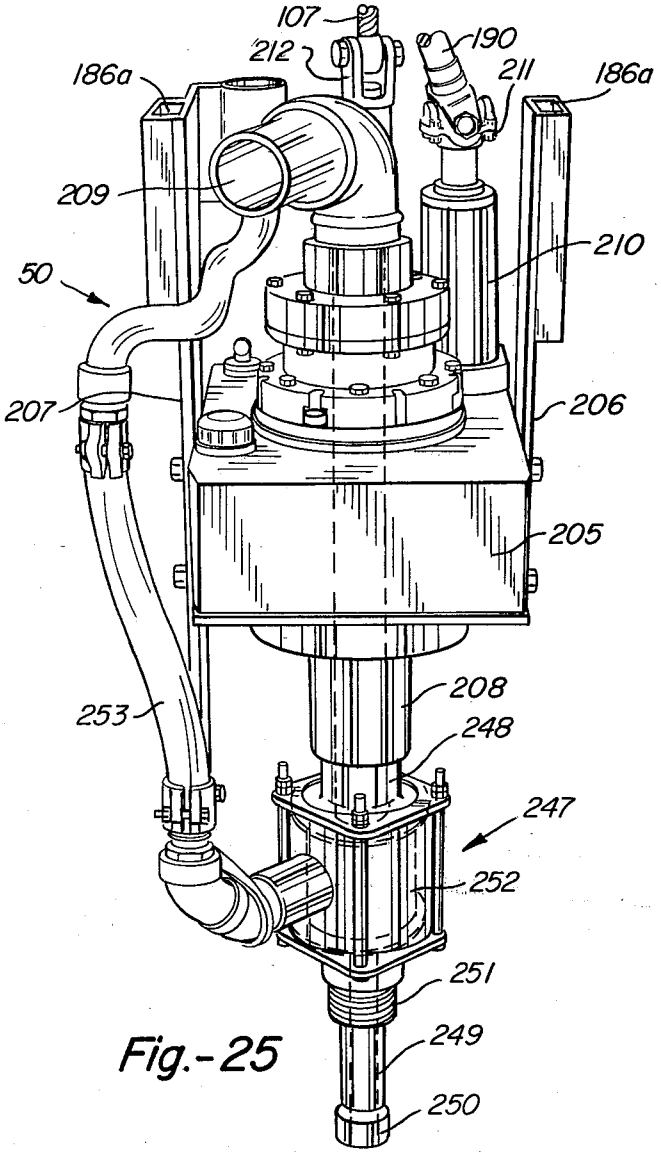
FIG. 25 is an enlarged perspective view of the rotary drill head shown at FIGS. 22 and 23, but with an adaptor for using a double-walled drill pipe where fluid circulation is completely within the pipe.

FIG. 25 shows the drill head 52 adapted for a double wall drill stem 53 where fluid, air or water will move downwardly through the space between the two pipe walls and return through the center pipe. The drill head 52 carries an adaptor 247 at the bade of the output shaft 208 which includes a stub shaft 248 which threads into the output shaft 208 to rotate therewith. A central passageway through the stub shaft extends through a reduced diameter stem 249 at the bottom of the stub and a sized stem 250 at the bottom which fits the central passageway of the drill pipe forcing fluid flow therein and through the elbow 209. A pipe thread 251 above connects with the drill stem and a gland 252 wherein the stub rotates is located above the thread 251, in suitable flanges with proper fluid seals. An air or water supply line 253 to the gland forces the fluid through a passageway about the stem portion and into the outward space between the inner and outer pipe walls. The return flow is through the inner pipe and through the central passageway of the adaptor.

The Rotary Diamond Drill Head 55

Figure 26:
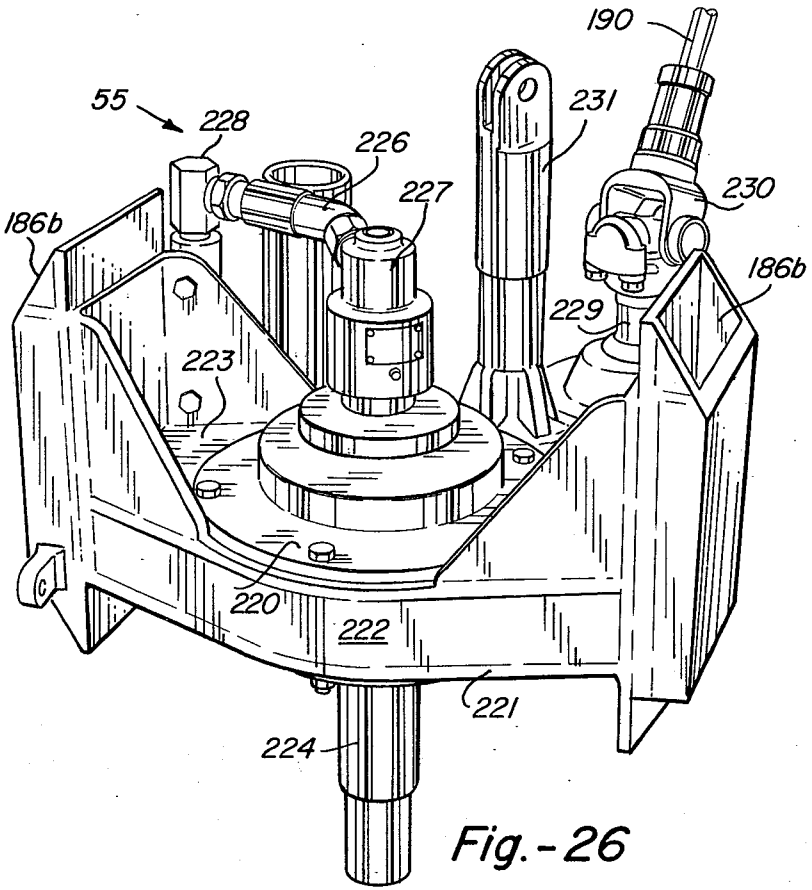
FIG. 26 is an enlarged perspective view of a rotary diamond-bit type drill head adapted to be held at the base of the carrier frame shown at FIG. 20.
Figure 27:
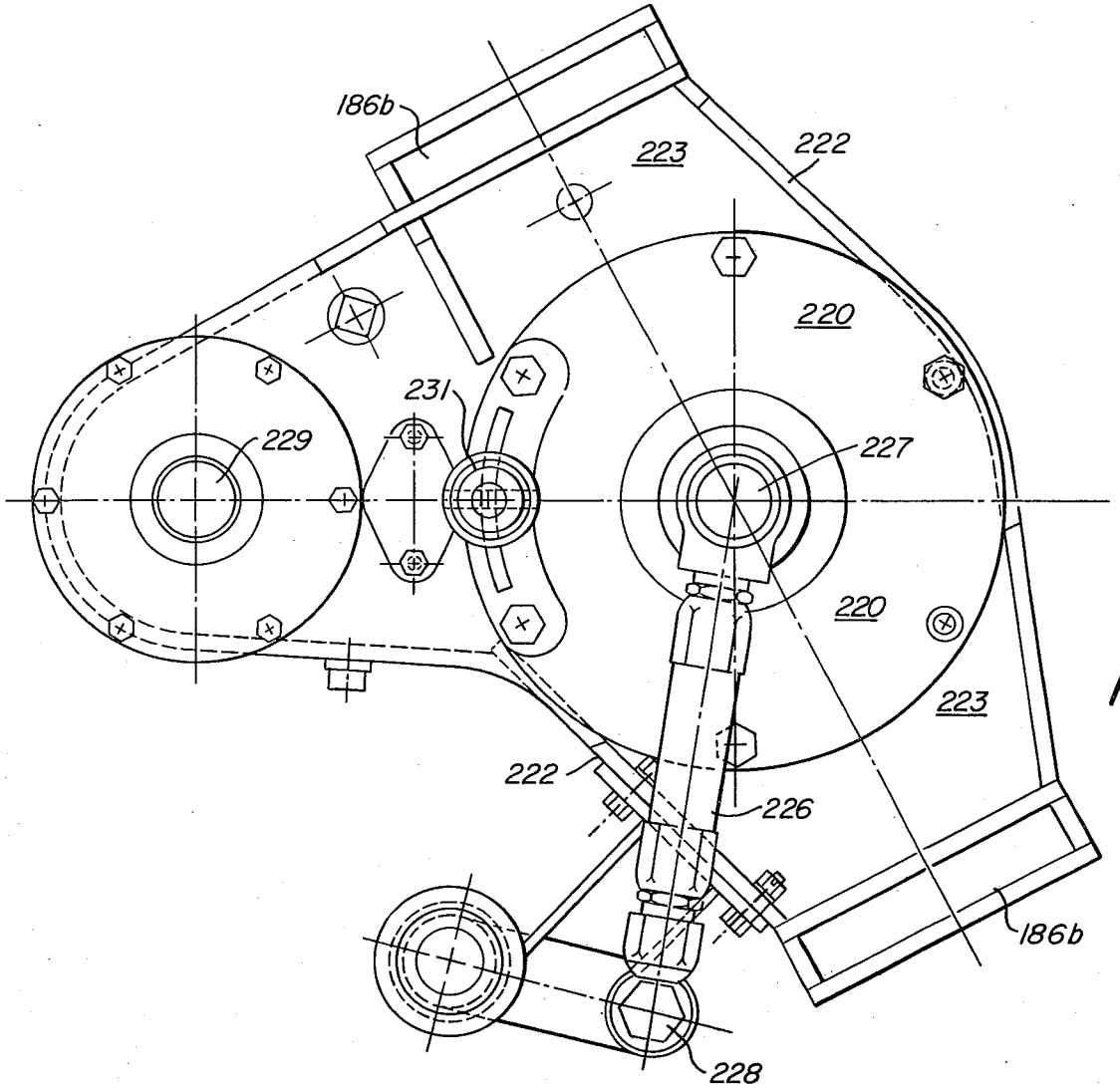
FIG. 27 is a plan view of the apparatus of FIG. 26.
Figure 28:
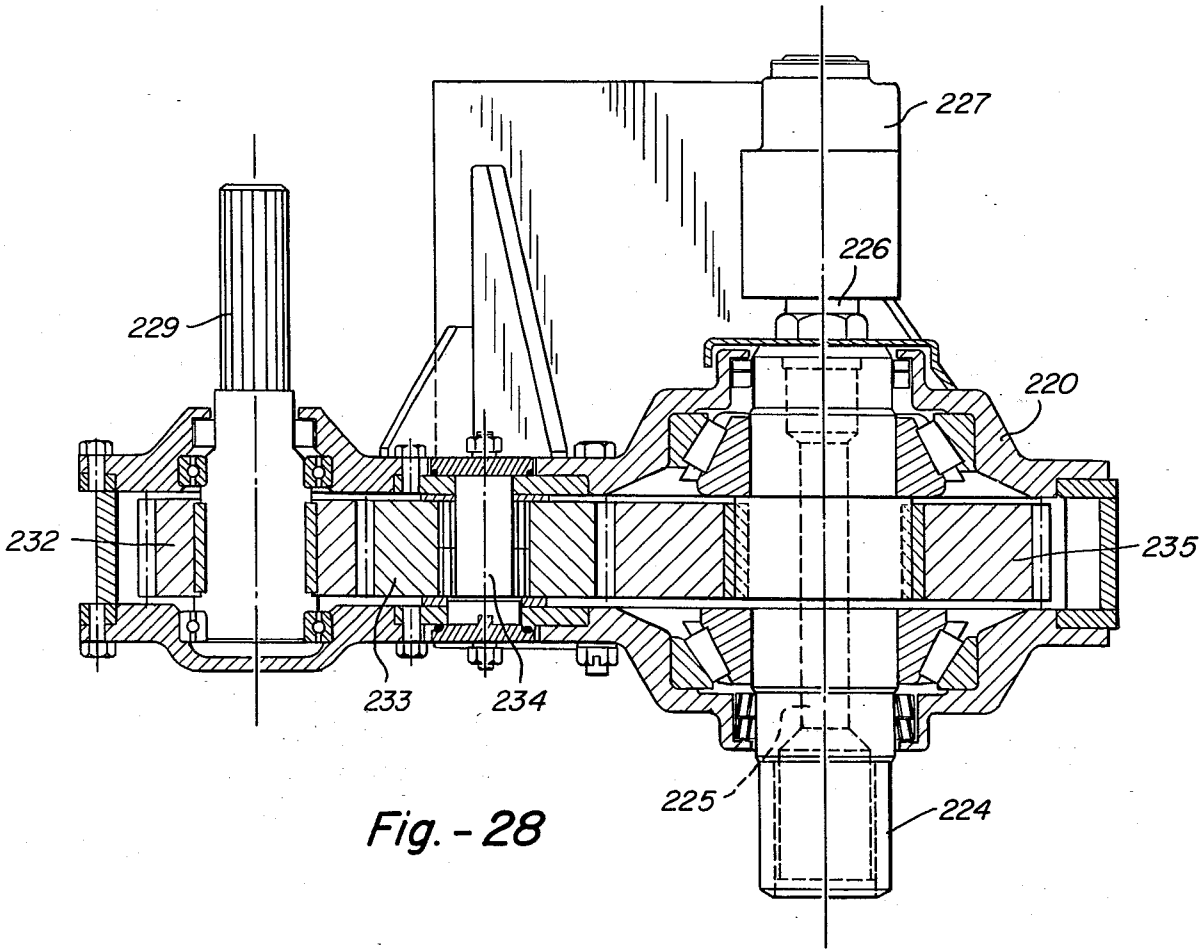
FIG. 28 is a cross sectional view on an enlarged scale of the gear box of the diamond drill head shown at FIG. 26.

Referring to FIGS. 26, 27 and 28, the diamond drill head 55 shown by these figures may be installed on the tongues 185 by removing the pile driver spout 177. Once installed, the drill head 55 is connected with the drive shaft 190. The drill head is built about a gear box housing 220 which is embraced by a box-like case 221 having side plates 222 and a lid plate 223 at the case. Arm portions of this case 221 extend in diametric opposition from a centered output shaft 224 in the case and to sleeves **186*b* to receive the tongues 185 of the carrier side plates 178R and 178L** so that the diamond drill is carried by the tongues.

The output shaft 224 extends through the gear box and has a passageway 225 through it which is threaded at the bottom to connect with a drill rod 56 depending therefrom. The passageway 225 through this shaft connects with a fluid supply line 226 at the top of the gear box which includes a suitable elbow 227 and swivel connection 228 to facilitate good connection with a conventional fluid supply piping as the drill moves up and down the mast during operation. The input to the gear box is at a spline shaft 229 connected to a universal coupling 230 and thence to the drive shaft 190. A post 231 upstands from the lid plate 223 with a clevis at the top for connection with the lift cable 107 to facilitate mounting the unit onto the carrier.

Referring to FIG. 28 the gear train within the gear box is selected to provide a comparatively high speed output for the shaft 224 which is only slightly less than the high speed rotation of the drive shaft 190. The gears include an input gear 232 keyed to the input spline shaft 229 which engages an idler gear 233, bearing mounted on a fixed shaft 234. The idler gear is engaged by a drive gear 235 keyed to the output shaft 224. Suitable seals, keys and bearings hold the gears in place, all of which are conventional and need not be further described.

The Jackhammer 57

Figure 20:
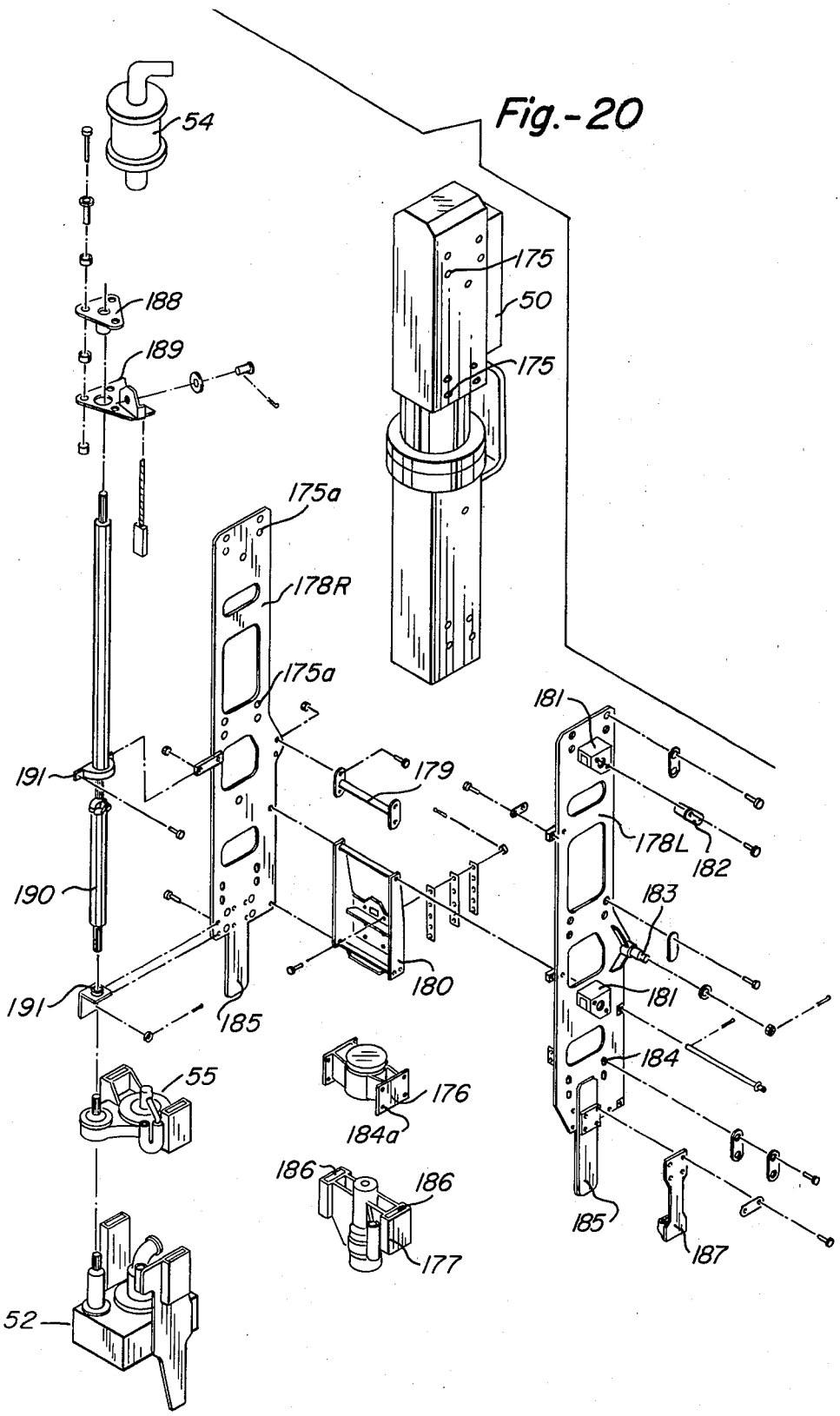
FIG. 20 is an exploded perspective view of the drilling apparatus carrier frame and of various drilling apparatus which may be mounted thereon being shown in exploded-view relationship.

Referring to FIGS. 5 and 20, the jackhammer 57 is mounted upon a transverse bracket 180 which is spaced between the rearward edges 178R and 178L in such a manner as to align the drill steel 58 connected to the jackhammer with a hole drilled by a rotary drill or diamond drill whenever the carrier 41 is shifted into the slide frame pocket 162 and against the mast as best illustrated at FIG. 5.

The Puller Ground Shoe

FIGS. 1 and 2 show a puller ground shoe **47*a* which is used with the pile driver to pull a pile out of the ground. This puller ground shoe 47*a* has the same mounting arrangement as the breakout ground shoe 47. Brackets 126*a* connect with the base of the mast to carry a U-shaped wall 160 which in turn carries a flat shoe plate 120*a*. The plate 120 bears against the ground and a pile extends through a passageway 48*a* when the apparatus is in use. A pile is lifted by increments with a pair of cylinders 161 upstanding from the shoe plate 120*a* at opposite sides of the passageway 48*a*. Balanced hanger straps 162 from each side of each cylinder are connected with horizontal sill bars 163. The pile is connected to the sill bars in any suitable manner and extension of the cylinders will lift the pile an increment. It may then be held in the passageway 48*b*** by slips to permit the cylinders to be lowered to get another grip on the pile for raising it another increment.

Summary

The manner in which the improved drill rig is used and its versatility is manifest from the foregoing descriptions. Other auxiliary, optional pieces of equipment are well adapted for the apparatus. For example, a pipe boom may be attached to the apparatus to load the mast with drill pipe especially when drilling an angle hole. A pipe changer may be added to assist in handling pipe when rotary drilling. It is obvious that others skilled in the art can build and devise alternate and equivalent constructions which are within the spirit and scope of the present invention. Hence, we desire that our protection be limited, not by the constructions illustrated and described, but only by the proper scope of the appended claims.

What we claim is:

1. A drill rig for drilling a hole in the ground comprising:

(a) a mast, having a longitudinal slide means at one mast face thereof for enabling longitudinal movement therealong, said mast being adapted to be set upright at one side of a drill hole to be drilled with the rig, with said mast face and said slide means thereon facing, and being at a selected spacing from and being parallel to the axis of the drill hole;

(b) a slide frame mounted upon said longitudinal slide means and lifter-pulldown means in the mast for causing movement of said slide frame along the longitudinal slide means;

(c) a lateral shifting means on said slide frame shiftable outwardly from said mast face and the slide frame in the direction of the drill hole;

(d) a drill carrier attached to said lateral shifting means to be shifted between a first position adjacent an outward side of said slide frame and a second position spaced outwardly away from said mast and slide frame thereon;

(e) first and second separate drill mechanism means and drill pipe means being mountable upon said drill carrier for drilling the drill hole, with the drill pipe means being aligned with the drill hole axis after the drill carrier is selectively shifted to one of the first and second aforesaid positions; and (f) one of said separate drill mechanism means and drill pipe means being aligned with the drill hole axis when said drill carrier is at one of said first and second positions, and the other of said separate drill mechanism means and drill pipe means being aligned with the drill hole axis when said drill carrier is at the other of said first and second positions whereby to permit quick-change selective drilling with said first and second separate drill mechanism means and drill pipe means.

2. The drill rig defined in claim 1, wherein:

(a) a deck means is provided for supporting the mast with said drill hole axis being a short distance beyond an end of the deck means;

(b) a horizontally movable deck slide means is carried upon the deck means adjacent to said end of the deck means to shift the mast to said selected position at one side of the hole axis;

(c) a tippable mast slide means pivotally connected to the deck slide means to tip the mast to a selected inclination and to move it to an upright position, and wherein (d) the mast is slidably mounted upon the mast slide means at the end of the deck means and shifted on the mast slide means to a selected position with respect to the ground level.

3. The drill rig defined in claim 2, wherein said deck means carrying the drill rig is mounted upon a truck type vehicle.

4. The drill rig defined in claim 1, wherein said mast is essentially rectangular in cross-section, with four longitudinal cord members located at the corners thereof, with cross struts between the cord members at three faces of the mast and having a fourth open face with the cord members at the fourth open face defining said mast face and said slide means, and wherein said slide frame comprises opposing slots defined by slide channels engaging the cord members at said mast face.

5. The drill rig defined in claim 1 wherein said shifting means includes:

a pair of parallel links pivotally connected to the slide frame and to the drill carrier, said links swinging in unison, with the drill carrier being at the said first position when the links are swung upwardly to shift the drill carrier against the slide frame and being at said second position when the links are extended outwardly from the slide frame.

6. The drill rig defined in claim 5 including an arm brace at each link to hold the same in the aforesaid outward extension and wherein said shifting is effected by a diagonal cylinder extended from the slide frame to the drill carrier.

7. The drill rig defined in claim 1, wherein said drill carrier includes:

(a) a pair of tongues depending from each side of the unit;

(b) one of the drill mechanism means including a socket at each side thereof adapted to receive a tongue when the one drill mechanism means is mounted upon the drill carrier; and (c) a latch means is associated with the tongues to lock the drill mechanism means in place.

8. The one drill rig defined in claim 7 wherein the drill mechanism means is a pile driver mounted upon the drill carrier and the spout of the pile driver, has sockets to receive said tongues.

9. The drill rig defined in claim 7, wherein the one drill mechanism means is a rotary drill head having said sockets to be mounted upon the tongues.

10. The drill rig as defined in any preceding claim and comprising:

(a) a flat ground shoe at the bottom of the mast, outstanding from the mast to rest upon the ground and having a passageway therethrough, through which the drill pipe means passes to extend into a hole in the ground; and (b) means at the ground shoe to grip the drill pipe means.

11. The drill rig combination defined in claim 10, wherein the drill pipe means include (a) drill pipe sections which are threaded together, and (b) a drill pipe breakout means in said passageway adapted to grip a first pipe section within a hole, having its upper end extended through said passageway with a second pipe section thereabove connected to the first, and to forcibly rotate the first said pipe section to break and unscrew the threaded connection with a second pipe section thereabove where it is held against rotation.

12. The drill rig combination defined in claim 11, wherein the ground shoe includes an interior compartment and the drill pipe breakout means includes (a) a ratchet wheel within the ground shoe compartment having peripheral teeth and centered openings through which said drill pipe sections extend;

(b) a means to grip a drill pipe section at said centered opening; and (c) a hydraulic cylinder means within the said compartment adapted to engage ratchet teeth at the ratchet wheel to apply a thread-breaking torque against the ratchet wheel and the pipe held thereby.

13. The drilling combination defined in claim 12 including a spinning means associated with the ratchet wheel to rotate the same and rapidly unscrew the threaded joint between the aforementioned first and second pipe sections once it is broken.

14. The drill rig combination defined in claim 10 including a pulling means on the ground shoe to grip and to pull a drill pipe means stuck in a ground hole out of the ground.

15. The drill rig combination defined in claim 14 wherein the pulling means includes a hydraulic cylinder upstanding from the ground shoe at each side of the passageway.

16. The drill rig defined in claim 1 and further comprising a quick-change drill mechanism system and wherein:

(a) said drill carrier having a carrier supported mount means at opposite sides of its base and a drill mechanism motor means mounted thereabove for operating said drill pipe means;

(b) one of said drill mechanism means having a rotative-inhibiting mating mount means to engage and connect with said carrier supported mount means for preventing relative rotation therebetween, a central connector means at its underside for connection with the drill pipe means, and a motor connector means at its top-side for connection with the drill mechanism motor means.

17. In the drill rig combination defined in claim 16, wherein said carrier supported mount means and said rotative-inhibiting mating mount means includes a pair of tongues and a pair of sockets, with the tongues and sockets being at opposite sides of the axis of the drill pipe means, and means to lock the tongues within the sockets against rotation and separation whenever said drill mechanism means is engaged with said drill carrier.

18. In the drill rig combination defined in claim 16 wherein said carrier supported mount means includes a pair of depending tongues at opposite sides of the axis of the drill pipe means, and said rotative-inhibiting mating mount means includes a pair of sockets to receive the tongues, and including further, a means for locking the tongues within the sockets when said drill mechanism means is engaged with said drill carrier means.

19. In the drill rig combination defined in claim 18 wherein the drill mechanism motor means is a pile driver, the motor connector means is the drive anvil of the pile driver and the drill mechanism means is a spout having a top surface which engages the drive anvil of the pile driver.

20. In the drill rig combination defined in claim 18 wherein the drill mechanism motor means is a rotary motor means and the drill mechanism means is a case having rotary gear means within it with said motor connector means being a shaft upstanding from the case and said central connector being a shaft depending from the case.

21. The drill rig combination defined in claim 20 wherein said drill pipe means is tubular to permit the passage of fluid therethrough during a drilling operation and a packing gland means is carried at the drill mechanism means to permit fluid supplied through a tube means to flow to and from the drill pipe means as the drill pipe means rotates.

22. In the drill rig combination defined in claim 16 wherein said carrier mount means and said mating mount means include components at opposite sides of the axis of the drill pipe means.

23. In the drill rig combination defined in claim 16, including (a) said lateral shifting means adapted to hold the drill carrier in spaced parallelism whenever the drill carrier is shifted.

(b) means to actuate the lateral shifting means to selectively position the drill carrier towards the mast slide means and outwardly out therefrom whereby to permit the drill mechanism to be aligned with a drill hole when at said first position, to be offset from the hole when at said second position and thereafter to be quickly and accurately aligned with the drill hole when returned to said first position.

24. The drill rig combination defined in claim 16 wherein (a) a deck means is provided for supporting the most with said drill hole axis being a short distance beyond an end of the deck means;

(b) a horizontally movable deck slide means is carried upon the deck means adjacent to said end of the deck means to shift the mast to said selected position at one side of the hole axis;

(c) a tippable mast slide means is pivotally connected to the deck slide means to tip the mast to a selected inclination and to move it to an upright position, and wherein (d) the mast is slidably mounted upon the mast slide deck at the end of the deck and shifted on the mast slide means to a selected position with respect to the ground level.

25. The drill rig combination defined in claim 24, wherein said deck means carrying the drill rig is mounted upon a truck type vehicle.

26. The drill rig combination defined in claim 16 including:

(a) a mast support means including adjustment means to incline the mast to a selected upright position and to lower the mast so that its bottom will engage the ground;

(b) a flat ground shoe at the bottom of the mast, outstanding from the mast to rest upon the ground and having a passageway therethrough, through which the drill pipe means passes to extend into a hole in the ground; and (c) means at the ground shoe to grip the drill pipe means.

27. The drill rig combination defined in claim 26 including a pulling means on the ground shoe to grip and to pull a drill pipe means stuck in a ground hole out of the ground.

28. The drill rig combination defined in claim 26 including:

(a) drill pipe sections which are threaded together, and (b) a drill pipe breakout means in said passageway adapted to grip a first pipe section within a hole, having its upper end extended through said passageway with a second pipe section thereabove connected to the first, and to forcibly rotate the first said pipe section to break and unscrew the threaded connection with a second pipe section thereabove where it is held against rotation.

29. The drill rig combination defined in claim 28, wherein the ground shoe includes an interior compartment and the drill pipe breakout means includes:

(a) a ratchet wheel within the ground shoe compartment having peripheral teeth and centered openings through which said drill pipe sections extend;

(b) a means to grip a drill pipe section at said centered opening; and (c) a hydraulic cylinder means within the said compartment adapted to engage ratchet teeth at the ratchet wheel to apply a thread-breaking torque against the ratchet wheel and the pipe held thereby.

30. The drilling combination defined in claim 29 including a spinning means associated with the ratchet wheel to rotate the same and rapidly unscrew the threaded joint between the aforementioned first and second pipe sections once it is broken.

* * * * *